US011591886B2

(12) United States Patent
Lisk et al.

(10) Patent No.: US 11,591,886 B2
(45) Date of Patent: Feb. 28, 2023

(54) GULLET MANDREL

(71) Applicant: Oracle Downhole Services Ltd., Nisku (CA)

(72) Inventors: Mahlon Lisk, Nisku (CA); Levi Honeker, Nisku (CA)

(73) Assignee: Oracle Downhole Services Ltd., Nisku (CA)

( * ) Notice: Subject to any disclaimer, the term of this patent is extended or adjusted under 35 U.S.C. 154(b) by 51 days.

(21) Appl. No.: 17/094,147

(22) Filed: Nov. 10, 2020

(65) Prior Publication Data

US 2021/0140287 A1 May 13, 2021

Related U.S. Application Data

(60) Provisional application No. 62/934,951, filed on Nov. 13, 2019.

(51) Int. Cl.

| | |
|---|---|
| ***E21B 43/14*** | (2006.01) |
| ***E21B 34/08*** | (2006.01) |
| ***E21B 34/06*** | (2006.01) |
| ***E21B 43/12*** | (2006.01) |

(52) U.S. Cl.

CPC ..... *E21B 43/123* (2013.01); *E21B 34/08* (2013.01); *E21B 34/066* (2013.01)

(58) Field of Classification Search

CPC ..... E21B 43/123; E21B 34/08; E21B 34/066

See application file for complete search history.

(56) References Cited

U.S. PATENT DOCUMENTS

| | | | |
|---|---|---|---|
| 5,273,112 | A | 12/1993 | Schultz |
| 5,937,945 | A | 8/1999 | Bussear et al. |
| 6,070,608 | A | 6/2000 | Pringle |
| 6,435,282 | B1 | 8/2002 | Robison et al. |

(Continued)

FOREIGN PATENT DOCUMENTS

| | | | |
|---|---|---|---|
| CA | 2856184 | A1 | 1/2015 |
| CA | 2873541 | A1 | 6/2015 |

(Continued)

OTHER PUBLICATIONS

International Search Report and the Written Opinion of the Canadian Intellectual Property Office for PCT Patent Application No. PCT/CA2019/050439 dated Jul. 2, 2019.

*Primary Examiner* — Michael R Wills, III

(74) *Attorney, Agent, or Firm* — Park, Vaughan, Fleming & Dowler LLP; Shane Nelson

(57) ABSTRACT

The present disclosure provides a gullet mandrel for fluid flow optimization in a wellbore. The gullet mandrel may be coupled to a downhole valve, such that a tubing string in a wellbore will have a plurality of valves coupled to a plurality of mandrels. Each gullet mandrel may have a valve recess and one or more gullets (or grooves) located in an exterior portion of the mandrel body. The gullets may have a wide variety of configurations, and may be formed in a portion, a majority, or substantially all of the mandrel. The gullets may direct movement of fluid exterior to the tubing string and help force fluid into a laminar or linear flow pattern and prevent the formation of slug flows and/or lessen the problems encountered by slug flows. The disclosed gullet mandrel may be used in any fluid injection or production operation, such as gas-lift operations.

41 Claims, 16 Drawing Sheets

(56) References Cited

U.S. PATENT DOCUMENTS

| | | | | |
|---|---|---|---|---|
| 6,715,550 | B2 | 4/2004 | Vinegar et al. | |
| 6,758,277 | B2 | 7/2004 | Vinegar et al. | |
| 6,776,240 | B2 | 8/2004 | Kenison et al. | |
| 6,951,252 | B2 | 10/2005 | Restarick et al. | |
| RE39,583 | E | 4/2007 | Upchurch | |
| 7,387,165 | B2 | 6/2008 | Lopez de Cardenas et al. | |
| 8,186,444 | B2 | 5/2012 | Patel | |
| 8,752,629 | B2 | 6/2014 | Moen | |
| 8,905,128 | B2 | 12/2014 | Arizmendi, Jr. et al. | |
| 9,228,402 | B2 | 1/2016 | Strilchuk | |
| 9,228,423 | B2 | 1/2016 | Powell et al. | |
| 9,291,033 | B2 | 3/2016 | Scott et al. | |
| 9,316,076 | B2 | 4/2016 | Longfield et al. | |
| 9,453,389 | B2 | 9/2016 | Anderson et al. | |
| 9,453,397 | B2 * | 9/2016 | Dowling | E21B 43/123 |
| 9,896,906 | B2 | 2/2018 | Tunkiel et al. | |
| 9,903,182 | B2 | 2/2018 | Getzlaf et al. | |
| 9,970,262 | B2 | 5/2018 | Werriers et al. | |
| 10,066,467 | B2 | 9/2018 | Getzlaf et al. | |
| 10,280,708 | B2 | 5/2019 | Lamb | |
| 10,323,481 | B2 | 6/2019 | Pratt et al. | |
| 10,443,344 | B2 | 10/2019 | Vasques et al. | |
| 10,480,284 | B2 | 11/2019 | Watson | |
| 2004/0055752 | A1 | 3/2004 | Restarick | |
| 2006/0124310 | A1 | 6/2006 | Lopez de Cardenas | |
| 2011/0139510 | A1 * | 6/2011 | Declute-Melancon | E21B 17/073 175/402 |
| 2012/0043092 | A1 | 2/2012 | Arizmendi | |
| 2015/0060084 | A1 | 3/2015 | Moen et al. | |
| 2016/0061004 | A1 | 3/2016 | Tunkiel et al. | |
| 2017/0336811 | A1 | 11/2017 | Stone et al. | |
| 2018/0020229 | A1 | 1/2018 | Chen et al. | |
| 2018/0202269 | A1 | 7/2018 | Wensrich | |
| 2019/0003284 | A1 * | 1/2019 | Coulston | E21B 34/14 |
| 2019/0085658 | A1 | 3/2019 | Reid | |
| 2019/0235007 | A1 | 8/2019 | Williamson et al. | |
| 2019/0316440 | A1 * | 10/2019 | Honeker | E21B 47/07 |
| 2019/0345799 | A1 * | 11/2019 | Foster | E21B 43/08 |
| 2020/0018136 | A1 * | 1/2020 | Bowen | E21B 34/14 |
| 2020/0080393 | A1 * | 3/2020 | Gumos | E21B 23/01 |
| 2020/0256134 | A1 * | 8/2020 | Fay | E21B 43/122 |
| 2021/0222522 | A1 * | 7/2021 | Greci | E21B 17/0283 |

FOREIGN PATENT DOCUMENTS

| | | | |
|---|---|---|---|
| CA | 2906464 | A1 | 3/2016 |
| CA | 2916168 | A1 | 6/2016 |
| CA | 3017294 | A1 | 9/2016 |
| CA | 2927973 | A1 | 10/2016 |
| CA | 2948249 | A1 | 5/2017 |
| CA | 2991729 | A1 | 1/2018 |
| CA | 2996116 | A1 | 8/2018 |
| CA | 2923662 | C | 10/2018 |
| EP | 1234100 | B1 | 2/2005 |
| WO | 2017204654 | A1 | 11/2017 |
| WO | 2019148279 | A1 | 8/2019 |

* cited by examiner

GULLET MANDREL

This application claims priority to U.S. provisional patent application No. 62/934,951, filed on Nov. 13, 2020, the entire content of which is incorporated herein by reference.

BACKGROUND OF THE INVENTION

Field of the Invention

The present invention relates to a system and apparatus for the production or injection of fluids from a wellbore, and particular for a downhole mandrel utilized in gas-lift operations, enhanced oil recovery (EOR) operations, and carbon dioxide ($CO_2$) sequestration.

Description of the Related Art

In the oil and gas industry, downhole valves are used as part of a tubing string to permit fluid communication between the formation or reservoir through which a wellbore intersects. Such valves may be used to produce fluids into the tubing string, which may be lifted to the surface using natural reservoir pressure or artificial lift solutions. Downhole valves may also be used to inject fluids into the wellbore or the annulus between the well casing and production tubing. Injected fluids can include chemicals to enhance oil recovery or stimulation fluids such as demulsifiers, corrosion inhibitors, scale inhibitors, or paraffin inhibitors. The various chemicals and their intended effects are well known in the industry.

Mechanically actuating downhole valves and controlling them to control their opening and closing are non-trivial issues, and many different solutions have been proposed and implemented in the art. Potential solutions must accommodate harsh downhole conditions, dimensional limitations imposed by tubing size, and other known difficulties. In general, conventional downhole valves are based on hydraulics and do not use control sensors to drive the position of the valve inlet/outlet; conventional valves are partially (or fully) opened or closed by hydraulic control lines from the downhole valve and the surface. Conventional valves present numerous problems. For example, a conventional hydraulic valve requires a separate control line from the wellhead to each downhole valve, which practically limits the number of downhole valves possible. Another problem includes complicated wellhead exits due to the number of control lines used in a well. Further, deep wells require increased surface pressure to actuate downhole valves, which becomes a safety hazard. Still further, if one return line is used for all downhole valves, if it fails, all the lines fail and/or all downhole valves are rendered inoperable.

There are existing technologies that relate to a downhole valve. See, e.g., U.S. Pat. Nos. 8,555,956; 8,776,896; 9,903,182; 9,970,262; 10,066,467; 10,280,708; and U.S. Patent Publication No. 2018/0171751, incorporated herein by reference. As another example, Schlumberger offers a production system named Manara. The Manara system utilizes a single control line that connects multiple downhole valves. However, the Manara product uses wellbore pressure to actuate the control valve, which is large and expensive.

A mandrel is generally known in the art as a bar, shaft, or spindle around which other components are arranged or assembled. For the purposes of this disclosure, it may also refer to specialized tubular components that are key parts of an assembly or system, such as a fracturing mandrel, a gas-lift mandrel, or a packer mandrel. A gas-lift mandrel is known in the art as a component assembled with the production tubing string to provide a way to locate and/or place valves used in an artificial gas lift operation. In some embodiments, a port in the gas-lift mandrel provides communication between the tubing annulus and the tubing interior passageway. A conventional mandrel is substantially cylindrical and/or tubular, such that a cross-sectional view of the mandrel may look like a circle. A tubing sub may also be considered a mandrel.

A need exists for an improved downhole valve and mandrel system and connection thereof. A need exists for an improved mandrel. A need exists for a connection coupling for a downhole valve to a mandrel. A need exists for an improved mandrel to efficiently and effectively couple a downhole valve to a tubing string. A need exists for an improved mandrel that stabilizes and/or assists fluid flow in a downhole application. A need exists for an improved apparatus and system for directing and/or controlling fluid in an annulus of a tubing string during production or injection operations.

SUMMARY OF THE INVENTION

The present disclosure provides a gullet mandrel for fluid flow optimization in a wellbore. The gullet mandrel may be coupled to a downhole valve, such that a tubing string in a wellbore will have a plurality of valves coupled to a plurality of mandrels. Each gullet mandrel may have a valve recess and one or more gullets (or grooves) located in an exterior portion of the mandrel body. The gullets may have a wide variety of configurations, and may be formed in a portion, a majority, or substantially all of the mandrel. The gullets may direct movement of fluid exterior to the tubing string and help force fluid into a laminar or linear flow pattern and prevent the formation of slug flows and/or lessen the problems encountered by slug flows. The disclosed gullet mandrel may be used in any fluid injection or production operation, such as gas-lift operations.

Disclosed is a downhole mandrel that comprises a body, a main passage within the body, and a plurality of gullets located in an exterior portion of the body. The mandrel may be configured to couple with a tubing string, wherein the main passage is fluidly coupled to a main passage of the tubing string. The mandrel may be a gas lift mandrel or one that is used for artificial lift applications. The main passage may be located substantially in a center of the body or off center within the body. The plurality of gullets may be configured to direct fluid in an annulus of a wellbore into linear flow and/or to prevent slug flow. The plurality of gullets may be configured to assist fluid flow movement in an annulus of a downhole well.

The plurality of gullets may be longitudinally positioned along a substantial length of the body. The plurality of gullets may comprise two, three, four, or more gullets. Each of the plurality of gullets may have substantially the same shape or size, or may have different configurations. The plurality of gullets may comprise one or more gullets with a first configuration and one or more gullets with a second configuration. Likewise, the plurality of gullets may comprise a first plurality of gullets with a first configuration and a second plurality of gullets with a second configuration. Each of the plurality of gullets may comprise a groove, which may be substantially arcuate, circular, cylindrical, triangular, or any other shapes. The plurality of gullets may be located symmetrically around the mandrel. The plurality of gullets may be helically arranged around the mandrel or arranged in a spiral around the mandrel. The plurality of gullets may be arranged in substantially straight lines around the mandrel. The mandrel may comprise a protrusion of the body located between each of the plurality of gullets.

The mandrel may comprise a channel that runs longitudinally along a substantial length of the body. The channel may be configured to receive a valve assembly. The mandrel may comprise a valve assembly positioned in a valve recess of the mandrel. The mandrel may comprise a shroud coupled to the body, such that the shroud protects any valve assembly and electronics while not substantially covering the plurality of gullets. The mandrel may comprise a shroud and a plurality of securing brackets that couple a valve to the body, wherein the shroud substantially covers the plurality of securing brackets.

Also disclosed is a downhole mandrel that comprises a body and one or more gullets located in an exterior portion of the body. The one or more gullets may comprise a plurality of gullets that run longitudinally along a substantial length of the body.

Also disclosed is a downhole valve system that comprises a plurality of mandrels coupled to a tubing string and a downhole valve coupled to each of the plurality of mandrels, wherein each of the plurality of mandrels comprises a plurality of gullets located in an exterior portion of the mandrel. Each of the plurality of mandrels may have the same shape. Each of the plurality of mandrels may have the same configuration of gullets. A bottom most of the plurality of mandrels may comprise a first gullet configuration and the remaining plurality of mandrels may comprise a second gullet configuration. A bottom most of the plurality of mandrels may comprise a plurality of spiral gullets and the remaining plurality of mandrels may comprise a plurality of substantially straight gullets. At least one of one of the plurality of mandrels comprises a shroud, while in other embodiments a majority or substantially all of the mandrels may comprise a shroud.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Figure 1A:
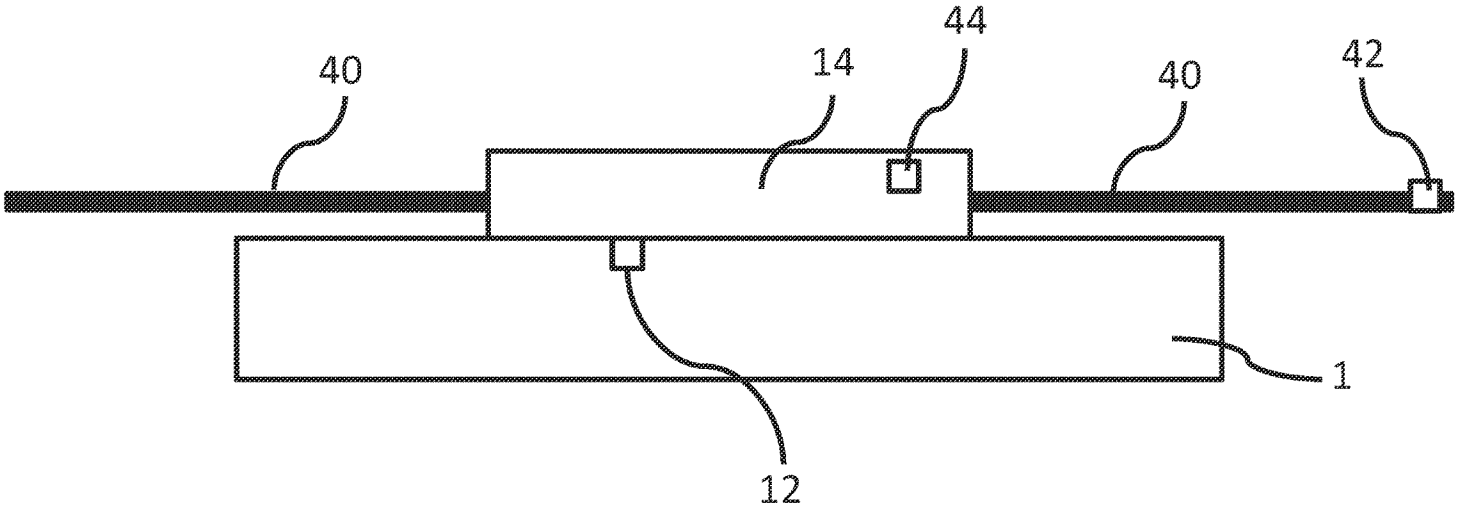
FIG. 1A illustrates a schematic view of a downhole valve assembly coupled to a tubing string according to one embodiment of the present disclosure.

Various features and advantageous details are explained more fully with reference to the nonlimiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure. The following detailed description does not limit the invention.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures, or characteristics may be combined in any suitable manner in one or more embodiments.

As used herein, longitudinal or "axial" means aligned with the long axis of tubular elements associated with the disclosure, and transverse means a direction that is substantially perpendicular to the longitudinal direction. As used herein, uphole and downhole are used to describe relative longitudinal positions of parts in the well bore. One of skill in the art will recognize that wellbores may not be strictly vertical or horizontal, and may be slanted or curved in various configurations. Therefore, the longitudinal direction may or may not be vertical (i.e., perpendicular to the plane of the horizon), and the transverse direction may or may not be horizontal (i.e., parallel to the plane of the horizon). Further, an uphole part may or may not be disposed above a downhole part. As used herein, tubing string may refer to any tubular structure in a wellbore that may be used to convey fluid in a wellbore. Non-limiting examples of tubing string include rigid pipe segments, and coiled tubing.

Overview

The content of U.S. Patent Publication No. 2019/0316440 ("the '440 Patent Publication"), entitled Downhole Valve for Production or Injection, is incorporated herein by reference.

Disclosed is a mandrel with one or more gullets located in an exterior portion of the mandrel body. The gullet mandrel may be coupled to a downhole valve, such that a tubing string in a wellbore will have a plurality of downhole valves coupled to a plurality of mandrels. The gullet mandrel may have a shroud or other covering over an exterior portion of the mandrel that protects the valve and other external components installed within the mandrel. Each gullet mandrel may have a valve recess and one or more gullets (or grooves) located in an exterior portion of the mandrel body. The gullets may have a wide variety of configurations, and may be formed around a portion, a majority, or substantially all of the exterior body of the mandrel. The gullets may be any configuration, such as any size or shape, and may be circular or non-circular, triangular, rectangular, etc. The gullets may be axially located around the mandrel and may be helical, spiral, or straight gullets positioned around the mandrel. The gullets direct movement of fluid exterior to the tubing string and help force fluid into a laminar or linear flow pattern and prevent the formation of slug flows and/or lessen the problems encountered by slug flows. The disclosed gullet mandrel may be used in any fluid injection or production operation, such as gas-lift and enhanced oil recovery operations and carbon dioxide sequestration.

Valve

In one embodiment, the utilized downhole valve assembly may be the same or similar to the valve described in U.S. Patent Publication No. 2019/0316440 ("the '440 Patent Publication"), which is incorporated herein by reference. However, one of skill in the art will recognize that this invention is not necessarily limited to such a valve, and other valves may similarly be used with the disclosed processes and methods described herein.

FIG. 1A illustrates a schematic of one embodiment of the present disclosure. Valve assembly 14 may be coupled to an exterior portion of tubing string 1. In one embodiment, the tubing string comprises conventional jointed tubing and is used to convey fluids in a wellbore. As is known in the art, tubing string 1 may have and/or be coupled to a plurality of tubing subs 310 (see FIG. 3A) that are positioned in line with the tubing string. The sub may have threaded ends which match the threaded ends of the jointed tubing. In one embodiment, the tubing sub may be in effect a downhole mandrel on which other components are arranged or assembled (such as the disclosed valve). As is known in the art, a mandrel is a specialized tubular component such as a bar, tube, shaft, or spindle around which other components are arranged or assembled. A tubing sub, as disclosed herein, may be used interchangeably with a mandrel. In one embodiment, a portion of the tubing string, such as the tubing sub, may have valve opening/orifice 12 through a wall of the pipe, which allows fluids to enter or exit the tubing string. Valve opening 12 is a controlled inlet and outlet orifice to the tubing string. In one embodiment, valve assembly 14 may be positioned adjacent to valve opening 12 such that a portion of the valve assembly with a lateral opening is in fluid connection with valve opening 12. As shown in detail in subsequent figures, valve assembly 14 comprises an additional passage that allows fluids to enter or exit the valve assembly as desired from an exterior portion of the tubing string (such as an annulus of a well), and consequently, allows fluid to enter or exit the tubing string through the fluid connection between valve 14 and valve opening 12.

In one embodiment, valve assembly 14 may be electronically coupled to other downhole equipment and the surface via electric cable 40. Electric cable 40 may be any downhole instrumentation cable, such as tubing encapsulated cable (TEC), and may transmit data and/or power between various downhole devices, such as a plurality of downhole valve assemblies and/or sensors. In one embodiment, cable 40 is a 4 conductor, ¼" TE cable that allows data communication between downhole equipment (tools, sensors, etc.) and the surface. Cable 40 may be directly or indirectly coupled to valve assembly 14, such as by induction means or wet or dry electrical connectors. In one embodiment, valve assembly may also comprise one or more sensors 44 to monitor various conditions downhole. Sensor 44 may be located within or adjacent to the valve assembly. In one embodiment, electrical cable 40 is directly coupled to a control circuit within the valve assembly, which is then directly coupled to one or more sensors 44. In one embodiment, sensor 44 may comprise a wide variety of sensors as is known in the art, such as temperature, pressure, acoustic, and flow rate. In another embodiment, cable 40 may also comprise sensors 42 (exterior to the valve assembly) to monitor various conditions downhole. Valuable data may be collected and read from the surface, in real-time or near real-time, by the telemetry sensors and/or cable 40.

As described herein, one embodiment of the disclosed valve assembly is coupled to a tubing sub (or mandrel) that is substantially in-line with a tubing string. The tubing string may be located in a horizontal, vertical, or lateral well. Further, the disclosed valve assembly can be attached to a tubing string, production liner, slotted liner, coiled tubing, and even surface lines. In other words, the disclosed valve assembly may be coupled to a wide variety of tubulars, fluid passageways, or fluid containing devices to control fluid flow in and out of the relevant device. Still further, while one embodiment of the disclosed valve assembly is located downhole, the valve assembly disclosed herein is not limited to downhole applications and in some embodiments may be used in surface applications.

Figure 1B:
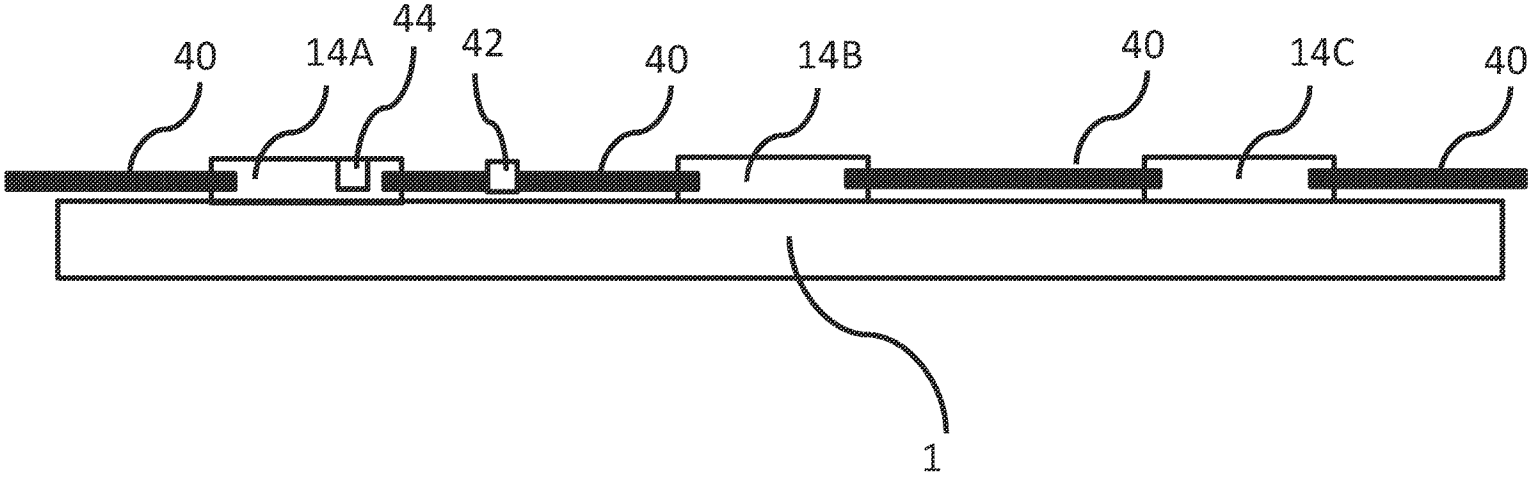
FIG. 1B illustrates a schematic view of a plurality of downhole valve assemblies coupled to a tubing string according to one embodiment of the present disclosure.

FIG. 1B illustrates a schematic of another embodiment of the present disclosure. In one embodiment, a plurality of downhole valves 14 (such as 14A, 14B, and 14C) may be coupled to tubing string 1. A single electrical cable 40 may be coupled to each valve and allow for remote electronic control of each of the plurality of valves at a remote location, such as the well surface. In one embodiment, the tubing string may be located in a horizontal well, a vertical well, and/or one or more lateral wells, and the plurality of valves (and sensors) allows for better monitoring and control of each section of the well. Depending on the connection to each of the valve assemblies, cable 40 may have a plurality of separate cable sections, but still may be considered as a single electrical cable. As in FIG. 1A, cable 40 may be coupled to a plurality of sensors 42, 44 positioned at different points along the cable to monitor downhole conditions along an exterior portion of the tubing string, such as within (see, e.g., sensor 44) and/or adjacent (see, e.g., sensor 42) to each of the valve assemblies. The use of downhole sensors connected to the cable allows for more accurate monitoring of downhole conditions, and in one embodiment, control of a particular valve assembly (and the results thereof) is monitored by the adjacent sensors. For example, valve assembly 14A may be directed to open to a certain "open" position, and the sensor(s) within valve 14A may be monitored to determine the effect of opening valve 14A on one or more fluid parameters, such as flow rate. Depending on the desired downhole parameter, valve 14A may be adjusted based on the results from sensors 44. Similarly, each valve may be separately controlled and monitored. In one embodiment, at least thirty (30) valves may be linked together to a single electrical cable for distances up to 5000 meters. Of course, one of skill in the art will realize that additional valve and additional distances may be achieved based on the design of the well, cable, and downhole assemblies. The valves may be separated by fixed, regular, or variable intervals.

Figure 2A:
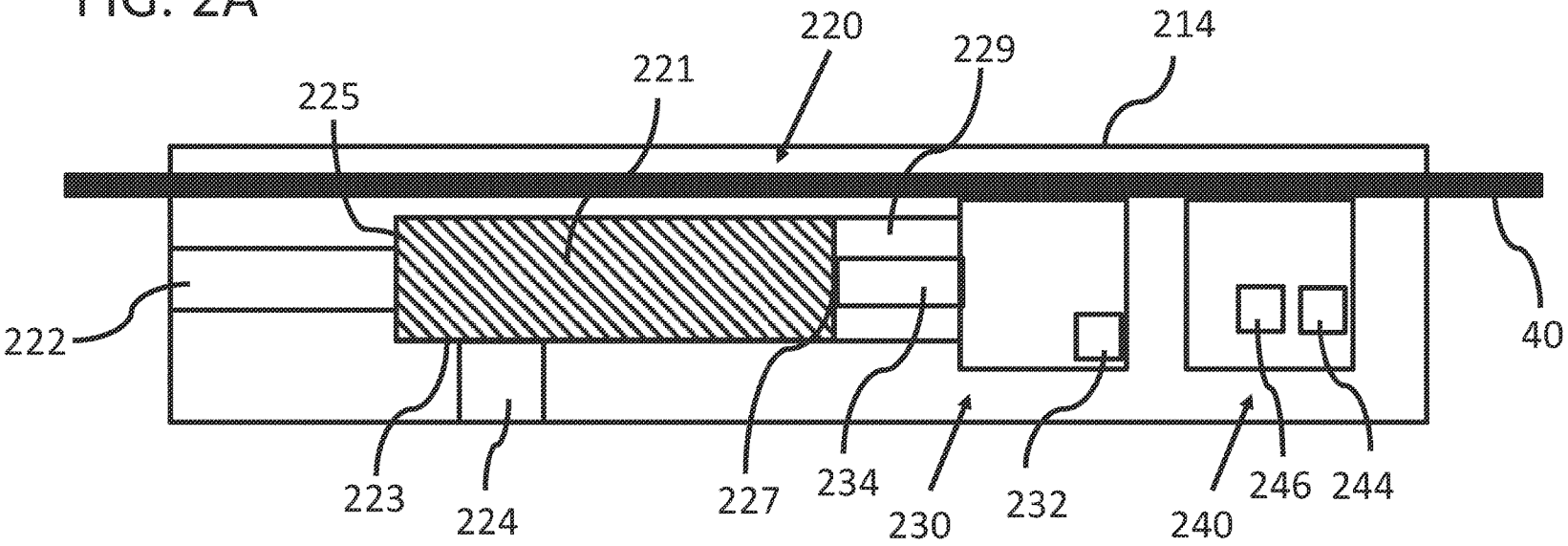
FIG. 2A illustrates a schematic view of a downhole valve assembly in a substantially closed position according to one embodiment of the present disclosure.
Figure 2B:
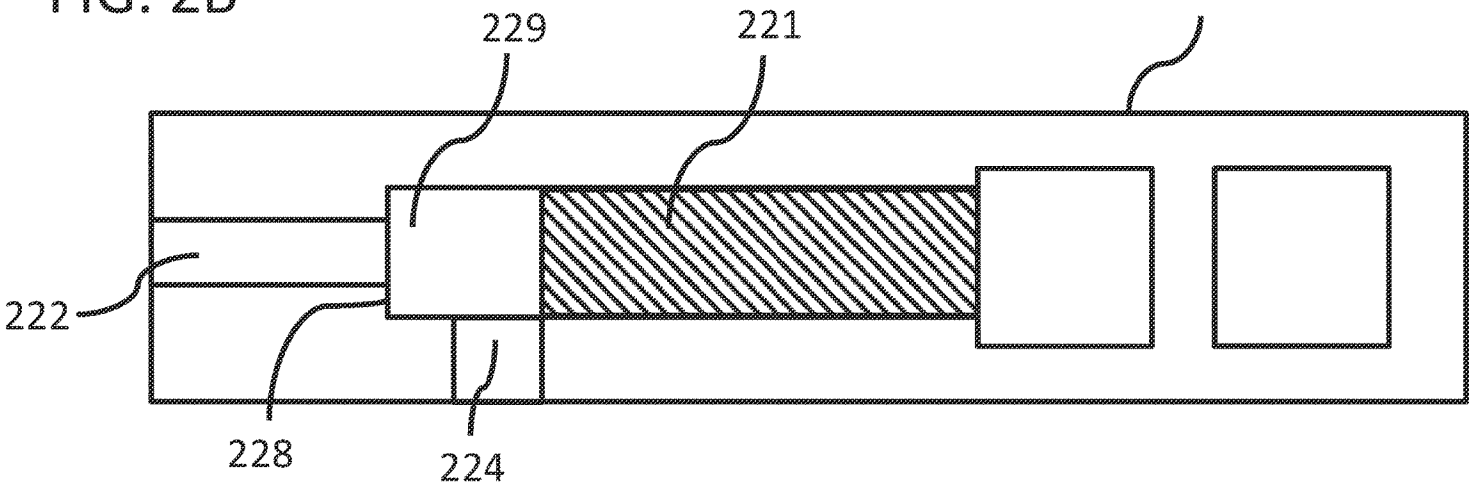
FIG. 2B illustrates a schematic view of the downhole valve assembly in a substantially open position according to one embodiment of the present disclosure.

FIGS. 2A and 2B illustrate a schematic view of one embodiment of a valve assembly of the present disclosure, in a substantially closed and open position, respectively. The valve assembly and components in FIGS. 2A and 2B are the same, but for simplicity many of the elements in FIG. 2B are not numbered. For the purposes of this disclosure, an open position may be considered as the position of the valve plug within the valve assembly when the plug (or dart) is retracted beyond orifice 224 to allow fluid flow between a first port and a second port of the valve assembly, while a closed position within the valve assembly may be considered as the position when the valve plug (or dart) contacts a sealing face or valve seat within the valve assembly to prevent fluid flow between the first and second ports of the valve assembly. Of course, the valve assembly may be actuated to any number of incremental positions between the substantially open and substantially closed position as desired and as described herein.

As illustrated in FIGS. 1A and 1B, valve assembly 210 may be coupled to a tubing sub and/or tubing string and be used to control fluid flow into or out of the tubing string at isolated locations along the tubing string. Valve assembly may be coupled to electrical cable 40, and as shown in FIG. 1B, a plurality of valves may be located on the tubing string and be electrically coupled together and/or with a remote location (e.g., the surface) via TEC cable 40.

As illustrated in FIG. 2A, in one embodiment, valve 214 comprises valve section 220, power section 230, and electronics section 240. In one embodiment, electronics section 240 is coupled to power section 230 which is coupled to valve section 220. In one embodiment, the various sections or systems may each comprise a number of elements. In one embodiment, each section and/or element of the valve assembly may be threaded and/or coupled together to form an inner cavity in which some of the valve assembly components fit within.

In one embodiment, valve section 220 comprises lateral port 224 that opens into valve chamber 229 and axial port 222 that opens into valve chamber 229. In one embodiment, port 222 is considered the main valve passage and/or exterior opening because it is in fluid communication with the exterior portion of the tubing string, such as fluids existing in the annulus of the borehole. In one embodiment, lateral port 224 may align with valve opening 12 (see FIG. 1A) when the valve assembly is properly positioned adjacent to the tubing string. In one embodiment, opening 222 is located on an axial side of the valve assembly, opens into valve chamber 229, and provides fluid communication between an exterior portion of the tubing string (such as the annulus of the borehole) and the valve assembly. Depending on the intended fluid flow direction, lateral port 224 may act as the inlet port while axial port 222 may act as the outlet port or, conversely, lateral port 224 may act as the outlet port while axial port 222 may act as the inlet port. In some embodiments, port 222 may be located on a lateral side of the valve assembly instead of an axial end, such as the opposing lateral side of chamber 229. As is known in the art, valve chamber 229 may be slightly larger than valve plug 221, and one or more seals may be arranged on the plug to seal against unwanted fluid flow. In one embodiment, valve plug 221 moves within inner chamber 229 in a longitudinal direction of the valve assembly.

In one embodiment, valve section 220 comprises valve plug 221 that is coupled to power section 230 via drivetrain 234. In one embodiment, valve plug 221 may have any number of configurations, such as a dart, flat face, stepped body, or knife. In one embodiment, plug 221 is an elongated dart with head 225, tail 227, and side 223. Plug 221 may be positioned within cylindrical valve chamber 229. In one embodiment, plug 221 is configured to seal against lateral port 224 and/or axial port 222. For example, a lower end of valve chamber 229 may have a valve seat 228 (see FIG. 2B) adjacent to opening 222 that is configured to receive a portion of head 225 of the valve plug. Thus, the valve plug is positioned within the valve assembly such that its head 225 is disposed within valve chamber 229 to seal against opening 222, port 224, and valve seat 228.

In one embodiment, valve plug 221 is moveable between a substantially closed position (see, e.g., FIG. 2A) and a substantially open position (see, e.g., FIG. 2B) to open and/or close (and anywhere there between) valve assembly 214. In one embodiment, plug 221 may be actuated to close valve opening 12 (see FIG. 1A) by covering lateral port 224 and sealing against valve seat 228. Valve opening 12 can be incrementally opened by moving plug 221 off of valve seat 228 and at least partially uncovering lateral port 224 (which fluidly connects opening 222 to lateral port 224). Valve opening 12 can be moved to a substantially open position by fully moving the plug off of valve seat 228 and substantially uncovering lateral port 224. In one embodiment, the disclosed valve plug is configured to move in very small increments to give fine control over the valve assembly and fluid flow through the valve. In one embodiment, valve assembly 214 allows fine control over valve opening 12 (as well as valve assembly 214) from any position from fully open to fully closed to accommodate any injection or production scenario. For example, if desired, the valve opening may be opened to approximately 26% if that is the particular opening preferred for the desired fluid flow rate. The amount of opening may be measured by a number of different attributes, such as flow rate, percentage opening of the lateral port, rotations/turns of the valve plug, or linear distance of the valve plug.

Valve plug 221 may be moved by rotation and/or linear movement of the valve plug. In one embodiment, valve plug 221 is coupled to drive shaft 234 which is coupled to motor 232. In one embodiment, the valve plug may be moved axially based on linear or rotational movement of the motor and/or drive shaft. In one embodiment, the valve plug may comprise a worm gear, ball screw, direct drive torque motor, or linear DC servo motor, each which is available to those of skill in the art. In one embodiment, drive shaft 234 extends through power section 230 and connects to motor 232. Thus, motor 232 is operatively coupled to valve plug 221 via drive shaft 234. In one embodiment, motor 232 rotates drive shaft 234 which subsequently rotates valve plug 221. In one embodiment, motor 232 is a reversible DC motor as is known in the art Electronics section 240 may comprise motor controller 246 and various sensors 244, such as telemetry, valve position, and electric sensors. In one embodiment, motor controller 246 is a conventional controller known to those of skill in the art and it is operatively coupled to motor 232. Controller 246 may be electrically controlled from the surface via cable 40. Controller 246 allows fine control over the motor.

Figure 2C:
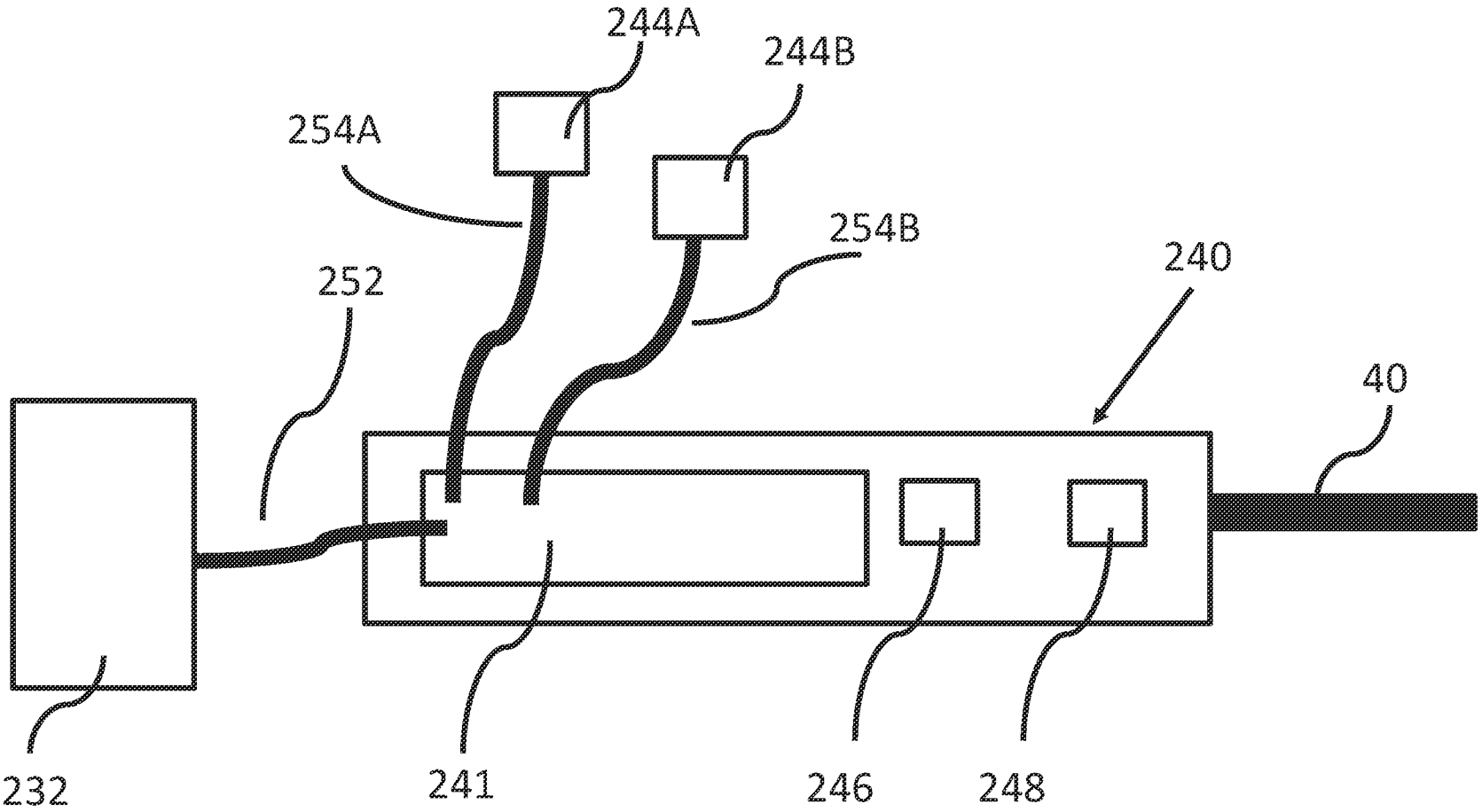
FIG. 2C illustrates a schematic view of an electronics section of a downhole valve assembly according to one embodiment of the present disclosure.

FIG. 2C illustrates a schematic view of one embodiment of electronics section 240 of the valve assembly of the present disclosure. In one embodiment, electronics section 240 is substantially similar to the electronics disclosed in FIGS. 2A and 2B. In one embodiment, electronics section 240 comprises circuit board 241, motor controller 246, and may have integrated sensors or sensor circuitry 248. TEC cable 40 may be coupled to electronics section 240, such as by being directly coupled to control board 241, and additional valve assemblies and/or a remote surface location. Thus, operators at a remote location may communicate with and/or control the downhole valve assembly via communication over cable 40 and electronics section 240. For example, an operator may have full control of valve opening 12 and/or valve assembly 214 from the surface (or another remote location, such as a portable handheld device or computer), without entering the well and without any additional tools. Electronics section 240 may also comprise one or more integrated sensors 244A, 244B, which may be any type of downhole sensor such as pressure, temperature, and/or water cut sensors. These sensors may be located within the valve assembly or external to the valve assembly. In one embodiment, the sensors are located within a chamber of the valve assembly, internal to the tubing string, and/or external to the tubing string. In one embodiment, the sensors may comprise position sensors that provide positive feedback and known orientation of the valve assembly and/or components within the valve assembly (e.g., the position of the valve plug). In one embodiment, control board 241 is coupled to motor 232 by wires 252, and sensors 244A and 244B are coupled to control board 241 via wires 254A and 254B, respectively. In one embodiment, wires 252 and 254 are contained within valve assembly 214 such that they are not exposed to any fluids or harsh environments.

As is known in the art, communication to downhole components over a long distance is problematic with any telemetry-based technology. In other words, signals from a power supply and/or remote location over a long length provide numerous issues, such as signal conditioning. Necessary software and user interface (UI) may be necessary, as is known in the art, to push power (TX) and receive data (RX) from a downhole valve to the surface at distances over 5000 km. The present disclosure allows real-time data communications and/or power to be transmitted to a plurality of downhole valves via a single electrical cable over distances over 5000 km and avoids numerous signal conditioning issues existing in the prior art. Using the appropriate user interfaces, the downhole valves and valve positions may be controlled from the surface or any other remote location. For example, any remote location can query the sensors for data and diagnostics for each valve. Further, the necessary control system and software allow for automation and control of the valves and valve positions based on real-time downhole conditions.

Figure 3A:
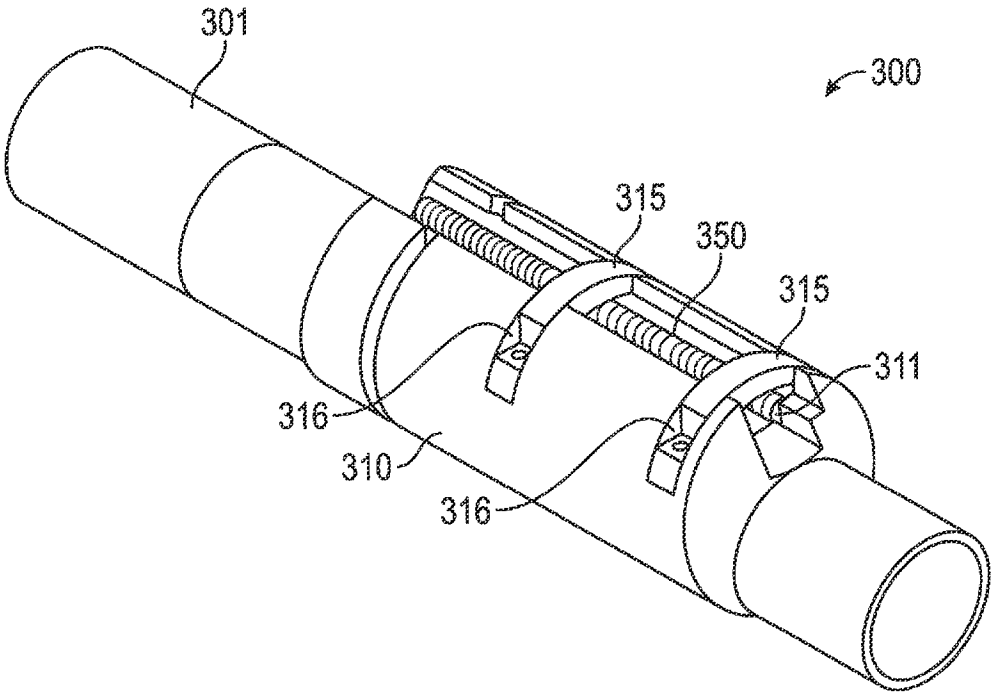
FIG. 3A illustrates a perspective view of a downhole valve assembly according to one embodiment of the present disclosure.
Figure 3B:
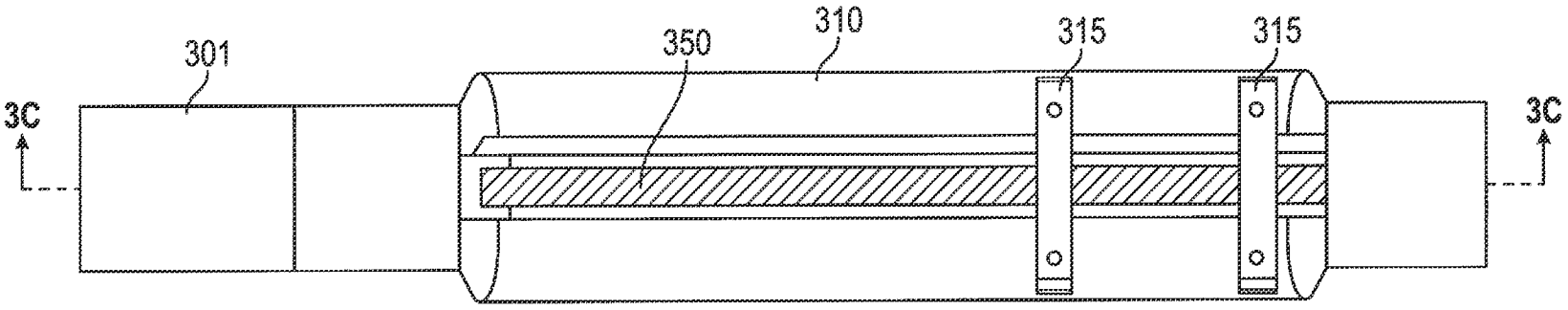
FIG. 3B illustrates a top-plan view of the embodiment from FIG. 3A.
Figure 3C:
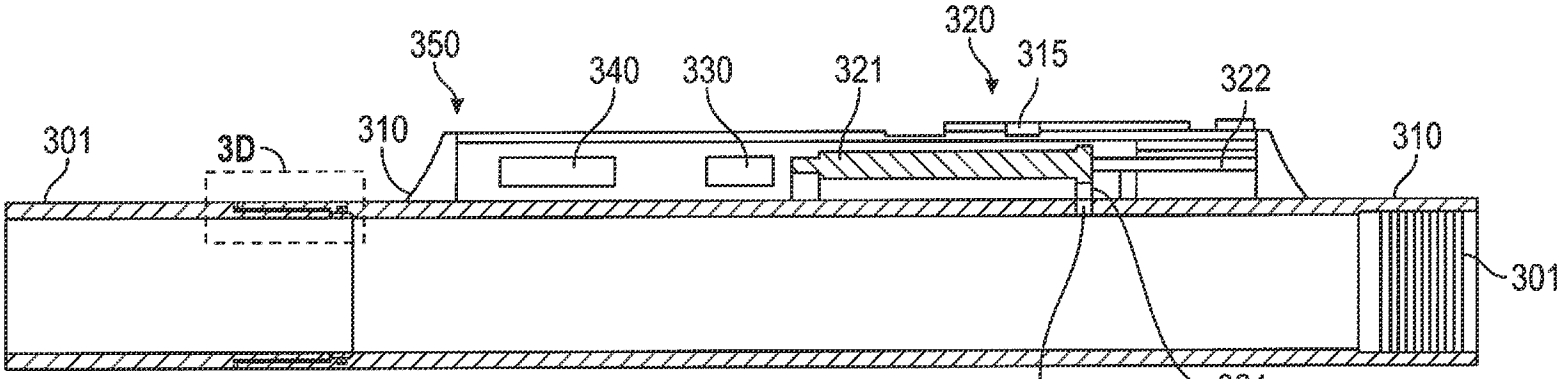
FIG. 3C illustrates a cross-sectional view along line 3C in FIG. 3B.
Figure 3D:
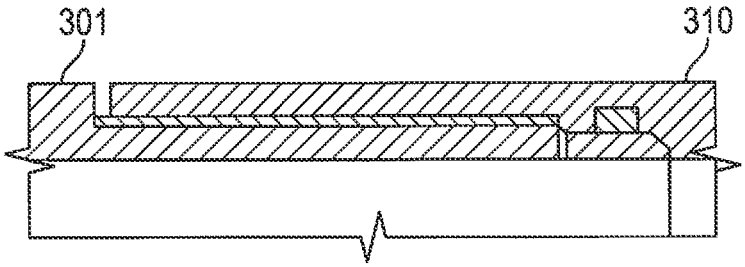
FIG. 3D illustrates a detailed view of portion 3D from FIG. 3C.
Figure 3E:
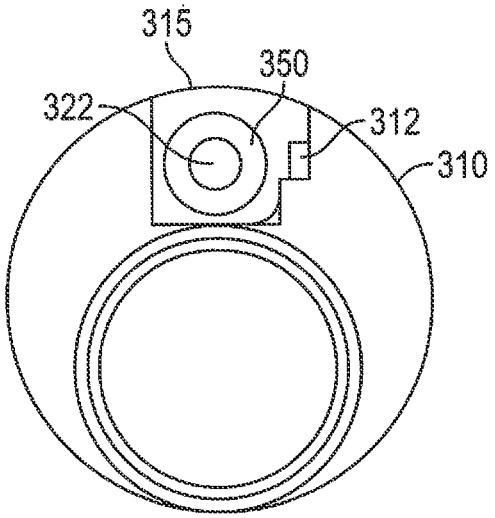
FIG. 3E illustrates an end-plan view of the embodiment from FIG. 3A.
Figure 3F:
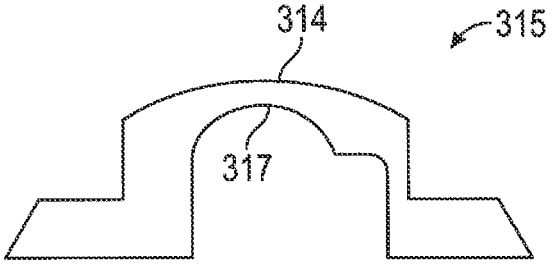
FIG. 3F illustrates an exemplary securing bracket for the valve assembly from FIG. 3A.

FIGS. 3A-3F illustrate various views of a valve assembly system according to one embodiment of the present disclosure. In particular, FIG. 3A illustrates a perspective view of one embodiment of the present disclosure showing a valve assembly coupled to a tubing sub, FIG. 3B illustrates a top-plan view of the embodiment from FIG. 3A, FIG. 3C illustrates a cross-sectional view along line 3C in FIG. 3B, FIG. 3D illustrates a detailed view of portion 3D from FIG. 3C, and FIG. 3E illustrates an end-plan view of the embodiment from FIG. 3A. FIG. 3F illustrates a securing bracket for the disclosed valve assembly according to one embodiment of the present disclosure.

In one embodiment, downhole valve system 300 comprises a valve assembly coupled to an offset tubing sub. For example, as illustrated in FIGS. 3A and 3B, valve assembly 350 may be coupled to offset tubing sub 310. In one embodiment, valve assembly 350 may be substantially similar to valve assemblies 14 and/or 214. As discussed above, tubing sub 310 may be configured to be placed in line with tubing string 301, and may be considered an offset sub or mandrel. As is known in the art, a tubing sub may have threaded ends (which may form a tubing coupling) which match the threads of the lengths of jointed tubing. For example, as shown in FIG. 3D, tubing sub 310 may have threaded ends which couple with threaded ends of tubing string 301. In other embodiments, the disclosed valve assembly may be coupled to other downhole tools or equipment, such as production liners, slotted liners, and coiled tubing. In one embodiment, the tubing sub may have a plurality of different diameters. For example, the threaded ends of the tubing sub may have a diameter that is substantially similar to a diameter of the tubing string, while a central portion of the tubing sub (where the valve is installed) may have a diameter that is larger than the diameter of the adjacent tubing string. In one embodiment, the diameter of the tubing string may be between 2-7 inches, such as approximately 2¾" tubing. In one embodiment, the tubing sub may have a length of approximately 16". In one embodiment, the tubing subs are coupled to the jointed tubing at the surface prior to insertion into the well; likewise, the valve assemblies are coupled to the tubing subs and a TEC cable is attached to each of the valve assemblies as the corresponding tubing section is inserted downhole. As illustrated in FIG. 1B, in one embodiment, a plurality of tubing subs and valve assemblies are provided along the length of the tubing string at different intervals, and a single TEC cable may be used to control all of the valve assemblies. In some embodiments, the tubing subs (and downhole valves) may be different sizes and/or diameters depending on their location on the tubing string.

Valve assembly 350 may be coupled to tubing sub 310 in any number of arrangements and by a variety of attachment mechanisms. In one embodiment, tubing sub 310 comprises trough or channel 311 that runs parallel to a long axis of the tubing sub. Trough 311 (or channel) is configured to receive valve assembly 350 within the channel and to couple the valve assembly to the tubing sub and/or tubing string. Electrical cable 40 and various sensors may also be positioned within the channel and/or adjacent to the valve assembly when coupled to the tubing sub. On either side of the trough may be located recesses 316 which allows one or more attachment devices to securely couple the valve assembly to the tubing sub and within the channel. As illustrated in FIG. 3F, in one embodiment, a plurality of securing brackets or clamps 315 attach the valve assembly to the tubing sub. In one embodiment, two brackets 315 (see FIG. 3B) are used to attach the valve assembly to the tubing sub. A portion of each securing bracket 315 may be received into recesses 316 on either side of channel 311. As illustrated in FIG. 3F, the securing bracket may have an exterior portion 314 that is curved and an interior portion 317 that is configured to receive the valve assembly and any cable coupled to the valve assembly. In one embodiment, a small gap (such as gap 312 in FIG. 3E) is located between valve assembly 350 and tubing sub 310, which allows cable to run alongside the valve assembly and be secured by the securing bracket. Of course, the disclosed valve assembly may be securely attached to the tubing string and/or tubing sub by a wide variety of attachment mechanisms besides securing brackets 315. For example, openings and/or locks may be disposed on an inside surface of the channel that couple with corresponding surfaces of the valve assembly. In other embodiments, clamps, pins, latches, or welds may be used to securely couple the valve assembly to the tubing sub.

The disclosed valve is well suited for small to large diameter tubing and annular spaces. In one embodiment, the unique configuration of the tubing sub, valve assembly, and coupling means between the tubing sub and valve assembly allow use of the valve assembly in small spaces, such as a 2⅜" diameter tubing in 4" casing (or even smaller). This compact configuration is substantially better than conventional valve designs. As one example, the disclosed valve assembly configuration does not affect the internals of the tubing string. For example, as compared to conventional valve technologies, the disclosed valve does not affect the internal diameter of the tubing, and thus may be used for smaller diameter pipe than traditionally possible. Of course, the valve can be scaled up for additional pipe sizes, such as up to 7" ID. However, in general, the disclosed valve may be used with any size tubing and casing.

As illustrated in FIG. 3C, tubing sub 310 may have an opening located on a wall of the tubing sub, which allows fluid to enter or exit the interior of tubing string 301. In one embodiment, valve opening 312 is located on a wall pipe surface of tubing sub 310 within channel 311. In one embodiment, a corresponding opening on valve assembly 350 is positioned adjacent to valve opening 312 to allow fluid flow between valve assembly 350 and the inside of tubing string 301 and/or tubing sub 310 and between the annulus of the tubing string and the interior portion of the tubing string.

As illustrated in FIG. 3C, valve assembly 350 may comprise electronics section 340, power section 330, and valve section 320. In one embodiment, valve section 320 comprises main passage/opening 322, lateral port 324, and valve plug 321. In an assembled configuration of the valve assembly and the tubing sub, lateral port 324 is adjacent to valve opening 312. In one embodiment, valve plug 321 comprises an elongated dart, with a head portion and a shaft portion, that is coupled to power section 330. In one embodiment, such as for fluid production from tubing string 301, main passage 322 functions as an outlet and lateral port 324 functions as an inlet for the valve assembly; in other embodiments, such as for well injection, main passage 322 functions as an inlet and lateral port 324 functions as an outlet for the valve assembly. As described herein, each of the openings 322 and 324 may have different configurations and be located at different positions within valve assembly 350. Likewise, dart 321 may have different shapes and be in communication with openings 322 and 324 based upon the different valve assembly configurations.

As illustrated in FIG. 3E, an end plan view of the disclosed valve assembly from FIG. 3A illustrates the positioning of the tubing sub, valve assembly, and cable. Brackets 315 securely attach valve assembly 350 to tubing sub 310. In the embodiment disclosed in FIG. 3E, valve assembly 350 comprises main passage 322 (which is in fluid communication with an annulus of the tubing string) that functions as the valve inlet or outlet depending on the intended fluid operation of the valve. Between valve assembly 350 and tubing sub 310 is located small recess 312 that runs parallel to the long axis of the valve assembly and tubing sub. Recess 312 is configured to receive cable 40.

Gullet Mandrel

The present disclosure provides an improved mandrel (and/or tubing sub) used to couple a downhole valve to a tubing string. In one embodiment, the coupled valve assembly may be the same or similar to the valve assembly described herein, but the invention is not limited to such a vale. In other embodiments, any type of downhole valve or downhole component may be coupled to the disclosed gullet mandrel and obtain the benefits described herein. While a gullet mandrel as disclosed herein is more difficult and costlier to manufacture, it provides superior operational benefits for wellbore operations, particularly for artificial gas-lift operations.

As illustrated in FIGS. 3A and 3E, a conventional mandrel or tubing sub is substantially cylindrical, such that a cross-sectional view of the mandrel may look like a circle. Such a tubing sub design is well known and easily manufactured. In contrast, the mandrel of the present disclosure has one or more gullets positioned in an exterior portion of the mandrel. In general, and for the purposes of this disclosure, a "gullet" is a gully, channel, or trough that is cut, formed, or otherwise prepared in an object. A "gullet mandrel" is a mandrel that includes one or more "gullets" located in an exterior portion of the mandrel that run parallel to a long axis of the mandrel (i.e., it runs longitudinally). A "gas lift mandrel" is a mandrel specifically used for gas-lift and other artificial lift operations in a wellbore.

Figure 4B:
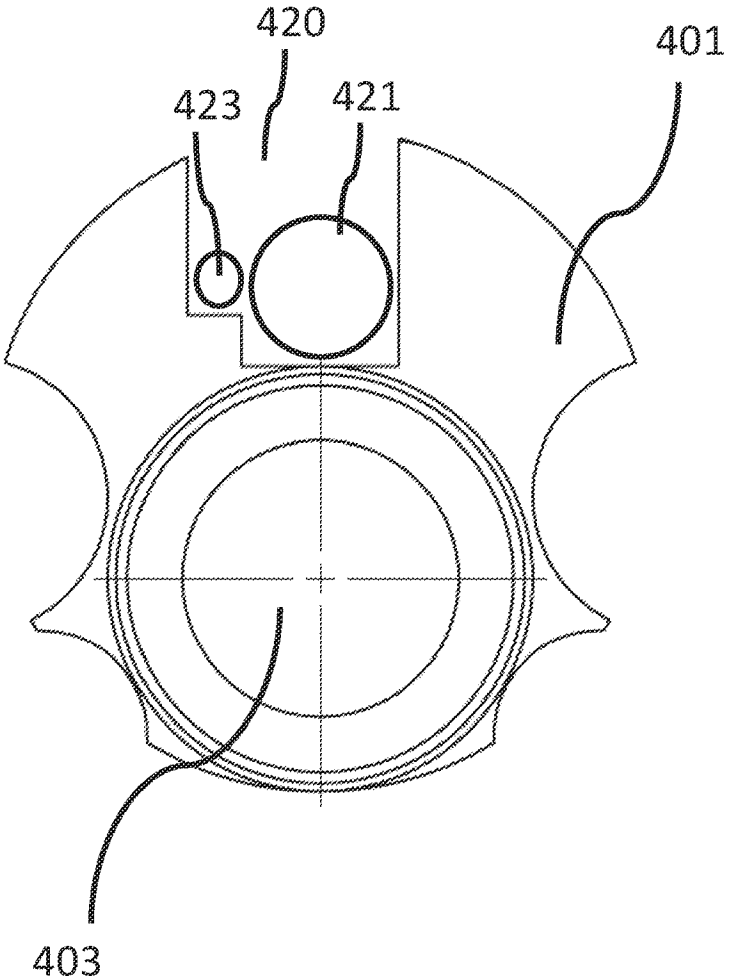
FIG. 4B illustrates a cross-sectional view of a gullet mandrel with a control valve and a control line according to one embodiment of the present disclosure.
Figure 4A:
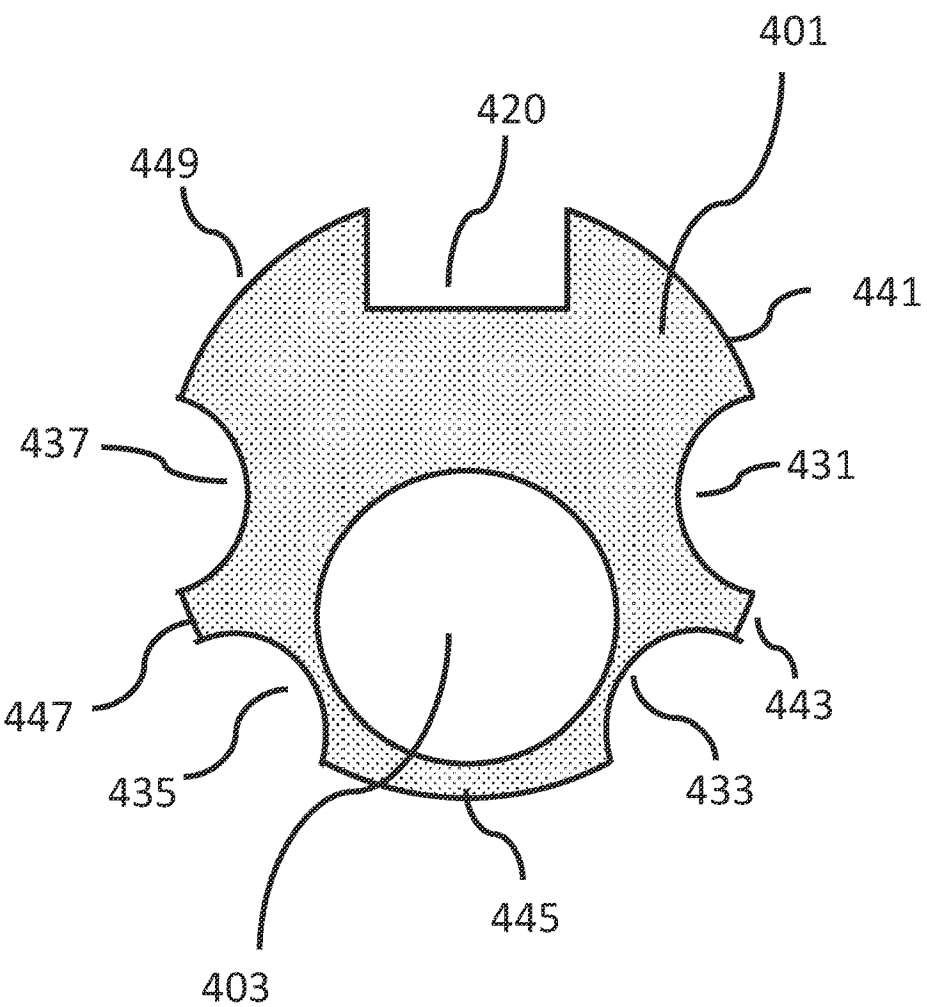
FIG. 4A illustrates a cross-sectional view of a gullet mandrel according to one embodiment of the present disclosure.

FIGS. 4A and 4B illustrate a cross-sectional view of a gullet mandrel according to one embodiment of the present disclosure. In particular, FIGS. 4A and 4B illustrate the positions of a trough, main passageway, and gullets relative to a mandrel. FIG. 4B illustrates control line 423 and valve 421 coupled to the mandrel located within recess or trough 420. For simplicity, some of the mandrel portions illustrated in FIG. 4A are not illustrated in FIG. 4B. As described herein, mandrel 401 has a main passageway 403 that is in fluid connection with valve 421 and the tubing string (see, e.g., FIGS. 1A, 2B, 3A, 3C). In one embodiment, valve 421 has a lateral opening that is coupled to an opening in a side wall of the mandrel, such that fluid may pass between the interior portion of the mandrel and an exterior portion of the mandrel. Main passage 403 (which is in fluid communication with an annulus of the tubing string) functions as the valve inlet or outlet depending on the intended fluid operation of the valve. Main passage 403 may be in the center of the mandrel 401 (see, e.g., FIGS. 5A-5F) or, as illustrated in FIG. 4A, may be off center and closer to one of the exterior sides, so that the other side of the mandrel is configured to receive valve 421. In one embodiment, the valve illustrated in FIGS. 1A, 1B, 2A, 2B, and 2C may be the same or similar to valve 421. As illustrated in FIG. 4B, adjacent to valve 421 may be cable 423 (which may be similar to cable 40) and may be located in the same recess as the valve or in an adjacent recess specifically configured for the cable.

In one embodiment, tubing sub 300 illustrated in FIGS. 3A, 3B, and 3C may be the same or similar to mandrel 401 but for the outer shape of the mandrel as described herein. In other words, mandrel 401 may be substantially similar to mandrel 300 but for the gullet shapes of the exterior portion of the mandrel. Similarly, FIG. 3E is substantially similar to the embodiment illustrated in FIGS. 4A and 4B but for the gullet shapes of the exterior portion of the mandrel. Likewise, valve 421 may be coupled to the mandrel 401 by one or more securing brackets, such as bracket 315 described in FIG. 3F, which are each located in a bracket recess 316. In one embodiment, bracket recesses 316 (see FIG. 3A) do not extend into the gullets; for example, the gullets may be positioned on parts of the mandrel separate from the mandrel portion in which the bracket recesses 316 and securing brackets 315 are located. In one embodiment, two or three securing brackets are utilized to couple the valve to the mandrel, which helps maintain a seal between the valve and an orifice in the mandrel (see FIGS. 2A and 2B and 3C, which allows fluid flow into an interior portion of the tubing string and mandrel), reduce vibration, and protect the valve during installation in the wellbore. More securing brackets may be necessary based on the length of the mandrel.

Trough or valve recess 420 may be located on one side of the mandrel and be configured to receive valve 421 and in some embodiments associated cable 423. While recess 420 is shown as rectangular in FIG. 4A, such an illustration is generic and many other shapes may be used, such as a cylindrical trough or similar channel or recess. In one embodiment the gullets are located along a substantial longitudinal portion of the mandrel, while in other embodiments only part of the mandrel may have the gullets. In one embodiment, the mandrel is long enough to contain the valve within the mandrel, but not substantially longer than necessary to contain the valve (see, e.g., FIG. 3A, 3B, 3C). In one embodiment, the portion of the mandrel which includes the valve (see, e.g., FIG. 3B) also comprises the gullets, and on either end of the valve the mandrel tapers off and/or transitions into threaded sections for coupling to the rest of the tubing string (in which there are no gullets).

Referring to FIG. 4A, in one embodiment, there are four gullets 431, 433, 435, and 437 located in the mandrel. In one embodiment, two gullets 431, 433 are located on a first side of the mandrel and another two gullets 435, 437 are located on another side of the mandrel, wherein a side is considered a portion on opposing sides or ends of the valve. In other embodiments, more or less gullets may be utilized. The gullets may be formed of any shape, whether circular or non-circular or otherwise arcuate, or cylindrical, rectangular, square, triangular, etc. In effect, the gullets are concave shapes cut or formed in an exterior portion of a mandrel, such as a concavity between two teeth on a saw. Likewise, the gullets may be relatively small or relatively large, which may partially depend on the shape of the gullet and the number of the gullets on the mandrel. Such gullets may be formed and/or cut (e.g., machined) from a particular object, or a mandrel may be formed (such as a non-metallic mandrel) with the gullet shapes formed from a mold.

Between each of the pairs of gullets is located a protrusion or tooth, much like a saw tooth between concave portions (e.g., gullets) of a saw blade. In one embodiment the protrusions form part of the cylindrical exterior body of the mandrel. For example, tooth/protrusion 443 is located between gullet 431 and gullet 433, while tooth/protrusion 447 is located between gullet 435 and gullet 437. Depending on the configuration of the gullets, a larger protrusion may be located between some of the gullets, such as protrusion 445. Likewise, a larger protrusion and/or different protrusion may be located between the gullets and valve recess 420. For example, protrusion 449 is located between gullet 437 and valve recess 420, while protrusion 441 is located between gullet 41 and valve recess 420. In the embodiment illustrated in FIG. 4A, the minimal mandrel thickness is located between passageway 403 and gullets 433 and 435. This may be considered a weak point or the point at which stress causes the most harm to the mandrel. In one embodiment, this material thickness is at least 0.25" thick, but may be thicker or thinner depending on the material used and the application of the mandrel. FIG. 4B illustrates an embodiment with even less mandrel thickness at that point. In one embodiment, gullets 433, 435 are as large as possible while still maintaining the necessary pressure strength (such as 5,000 psi or even 10,000 psi) for the mandrel.

In one embodiment, gullets 431, 433, 435, and 437 are each substantially the same shape and size. For example, each of these gullets may be substantially cylindrical, and may be approximately between 0.5" and 2.0" in diameter, and more particularly about 1.0" in diameter. In general, the configuration of the gullets may be completely variable based on the valve dimensions, the mandrel dimensions, and the type of completion and/or application of the downhole valves and mandrel. In other embodiments, two of the gullets may have a first size and shape (such as gullets 431 and 437), and two of the gullets may have a second size and shape (such as gullets 433 and 435). Such an embodiment of different sized gullets allows the maximum amount of material to be removed from the body of mandrel while still maintaining sufficient strength at particular areas, such as the boundary near main passageway 403. One of skill in the art will realize that a mandrel is not a two-dimensional object and any gullets formed in the mandrel will have a three-dimensional aspect and will extend partially, a majority of, or substantially all of the length of the mandrel. The gullets may be machined throughout the external cavity of the mandrel in any length and configuration depending on production limitations and/or gas lift supply requirements.

Figure 4C:
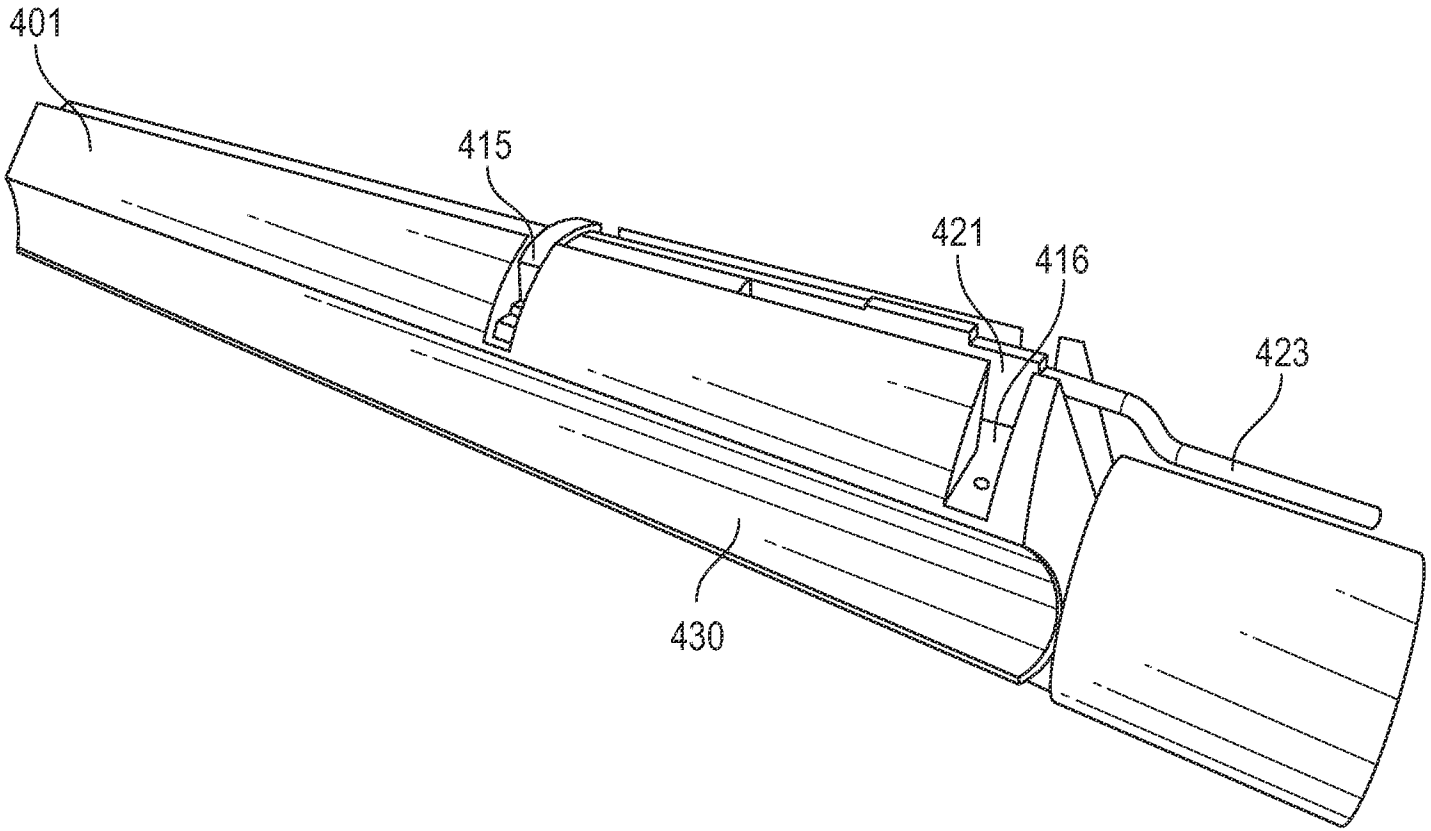
FIG. 4C illustrates a perspective view of a gullet mandrel according to one embodiment of the present disclosure.

FIG. 4C illustrates a perspective view of a gullet mandrel according to one embodiment of the present disclosure. A cross-section of the embodiment in FIG. 4C may be substantially similar to the embodiment illustrated in FIG. 4A, such that FIGS. 4A and 4C illustrate the same gullet mandrel embodiment. FIG. 4C illustrates mandrel 401 with gullets 430 running along a length of the exterior portion of the mandrel body. Only one gullet is illustrated in FIG. 4C, although one will recognize that additional gullets may be located on the bottom and the other side in a similar fashion as to gullet 430 (see, e.g., FIGS. 4A and 4B). Gullet 430 is substantially cylindrical and/or circular, and extends substantially in a straight line or path along a length of the mandrel. Cable 423 is coupled to valve 421, which is located within the mandrel in a trough, channel, or other valve recess 420. Securing brackets 415 (which may be similar to securing bracket 315 in FIG. 3F) are located within securing bracket recesses 416.

Figure 8A:
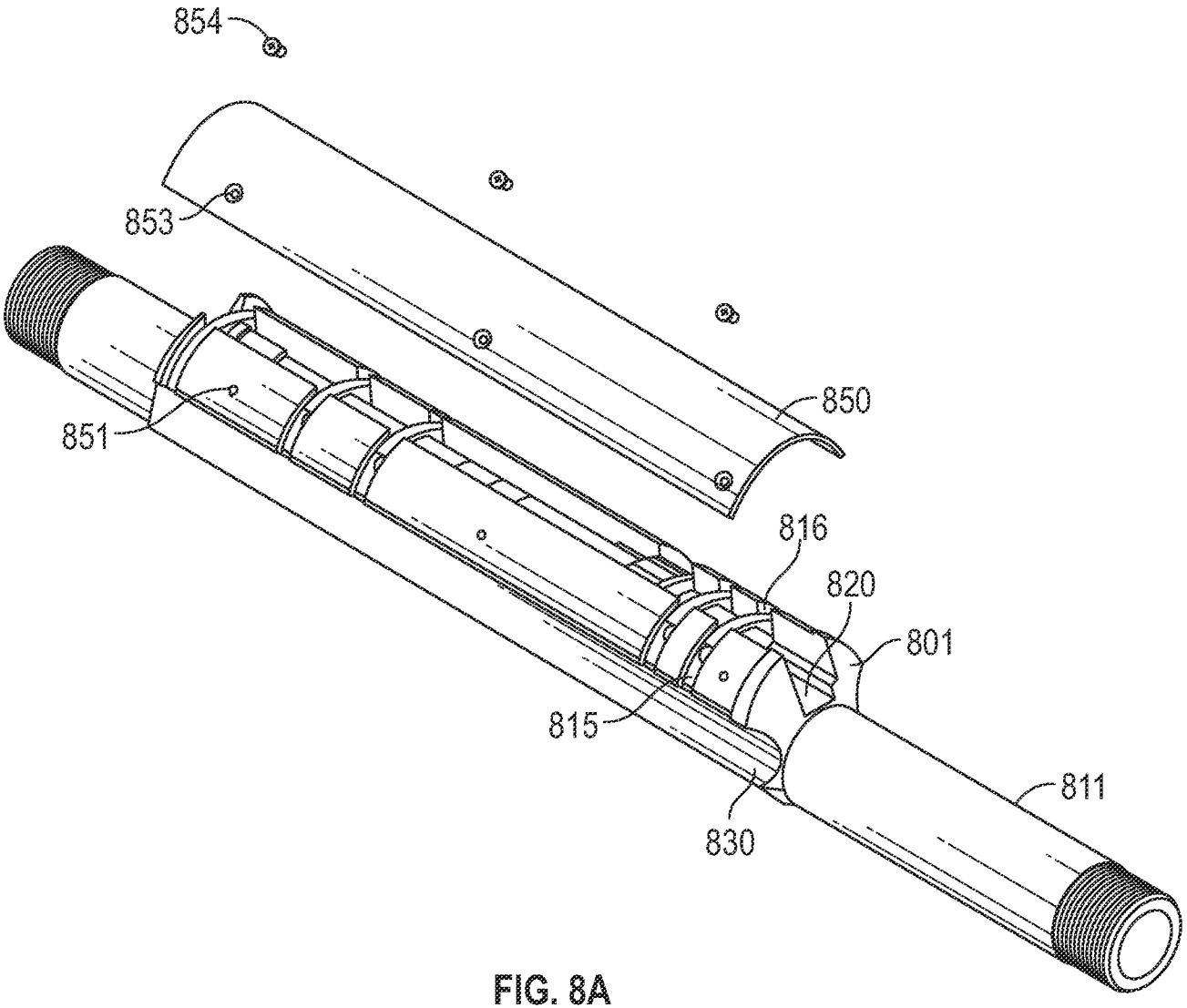
FIG. 8A illustrates a perspective view of a gullet mandrel with a shroud cover according to another embodiment of the present disclosure.
Figure 8B:
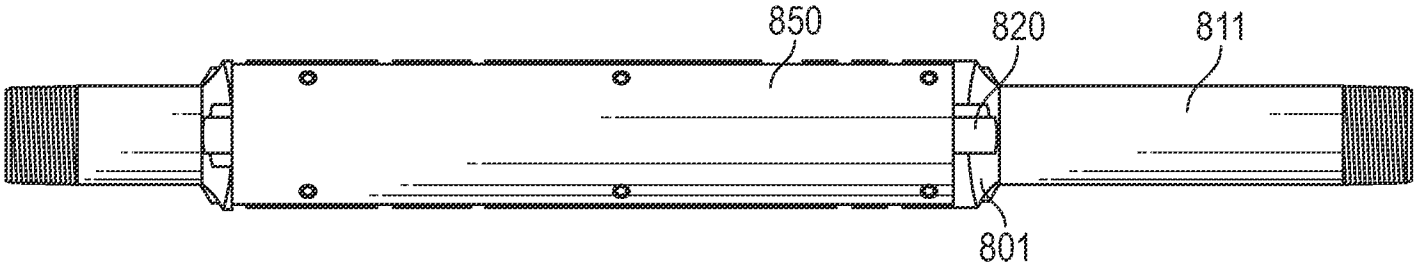
FIG. 8B illustrates a top-plan view of the embodiment from FIG. 8A.
Figure 8C:
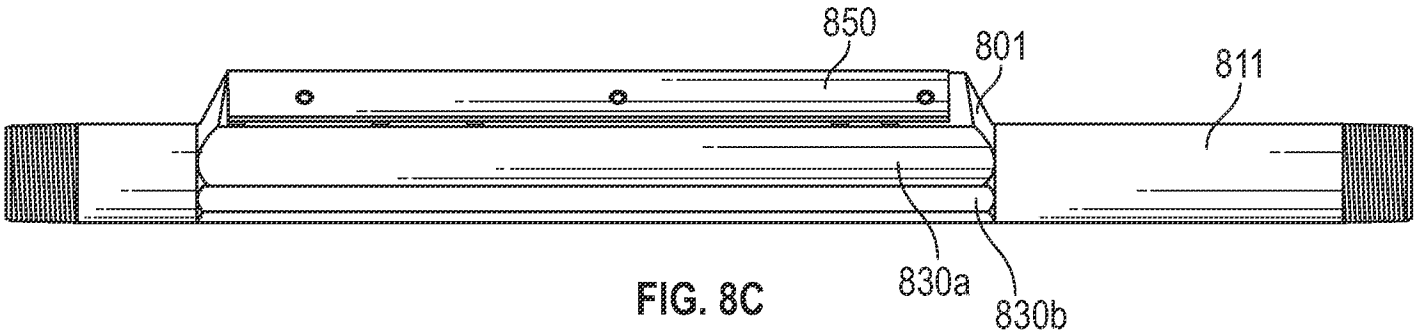
FIG. 8C illustrates a side-plan view of the embodiment from FIG. 8A.

In downhole conditions, the valve, control line, and other equipment coupled to a mandrel may be exposed to harsh conditions in the wellbore. Similarly, if the downhole valve and mandrel is utilized in open hole conditions (such as in the ocean), the mandrel may be subject to external forces (e.g., moving objects, debris, etc.) hitting the mandrel in addition to harsh conditions. To protect the mandrel, the equipment coupled to the mandrel, and/or the connections of the mandrel to the tubing, a shroud or other protective covering may be coupled to an exterior portion of the mandrel. Such an embodiment is illustrated in FIGS. 8A-8C. In particular, FIG. 8A illustrates a perspective view of a gullet mandrel with a shroud cover according to another embodiment of the present disclosure. FIGS. 8B and 8C illustrate a top-plan view and a side-plan view of the embodiment from FIG. 8A. Such a shroud is designed not to cover the gullets of the gullet mandrel.

Referring to FIG. 8A, gullet mandrel 801 is coupled to tubing string 811. Gullet mandrel 801 has a trough or recess 820 that is configured to receive electronic components, such as a valve and control line as disclosed herein. Gullets 830 may be located within exterior portions of the mandrel as disclosed herein and extend longitudinally down some or all of the length of the mandrel. A plurality of securing brackets 815 may be located in corresponding bracket recesses 816 in the mandrel and are utilized to securely couple the valve to the mandrel. The number of brackets is variable based upon the size and length of the mandrel and the electronic components coupled to the mandrel. A protective covering 850, such as a shroud, may be coupled to an exterior portion of the mandrel and may substantially enclose or cover trough 820 and securing brackets 815. In one embodiment, the shroud is designed not to cover the gullets to allow the gullets to serve their desired fluid flow optimization. In one embodiment, shroud 850 may be elliptical and/or shaped in an arc that corresponds to the shape of the gullet mandrel at the point of attachment, which is effectively a portion of a circle or the diameter and radius of curvature of the mandrel. The shroud may be couple to the mandrel by a wide variety of attachment methods, including screws, bolts, pins, latches, brackets, and other fastening mechanisms. In one embodiment, the shroud is coupled to the mandrel by a plurality of screws 854, with a corresponding plurality of holes 853 in the shroud and a plurality of holes 851 in the mandrel. The shroud may be metallic or non-metallic, such as a composite material. The shroud may be installed after the securing brackets are installed to the mandrel. Such a shroud covering protects the mandrel and enclosed components from harsh conditions and unintended physical contact. In one embodiment, the use of the shroud protects the valve and any electronic components from extreme pressure or temperature conditions and allows the valve to operate at more extreme conditions without operational failure. FIG. 8B illustrates shroud 850 covering substantially all of the trough and the securing brackets. FIG. 8C illustrates gullets in a side of the gullet mandrel, such as first gullet 830*a* and second gullet 830*b*. Two similar gullets would exist on the other side of the gullet mandrel. The gullet mandrel embodiment in FIGS. 8A-8C is similar to the embodiment illustrated in FIG. 3A. The primary differences in gullet mandrel 801 (in FIG. 8A) to gullet mandrel 300 (in FIG. 3A) is that gullet mandrel 801 is longer and thus requires more securing brackets to couple the enclosed valve to the mandrel, and a protective shroud is utilized to cover the enclosed electronics components and securing brackets.

FIGS. 5A-5F illustrate a cross-sectional view of various embodiments of a gullet mandrel according to the present disclosure. Such embodiments may be substantially similar to the embodiments illustrated in FIGS. 4A and 4B. One difference is the position of the main passageway in each of FIGS. 5A-5F as compared to FIGS. 4A and 4B. While passageway 403 in FIG. 4A is off-center (and located closer to an opposing side of valve recess 420), passageway 501 in FIGS. 5A-5F is located substantially in the center of the mandrel. A gullet mandrel as disclosed herein may have a main passageway in either the center of the mandrel or an off-center location.

Figure 5B:
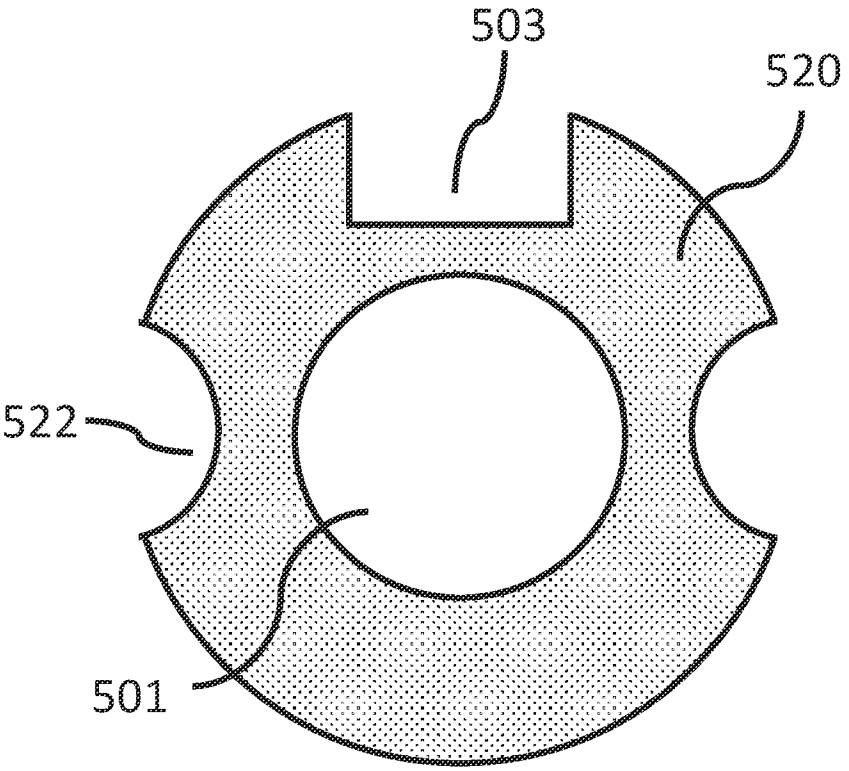
FIGS. 5A-5F illustrate a cross-sectional view of various embodiments of a gullet mandrel according to the present disclosure.
Figure 5A:
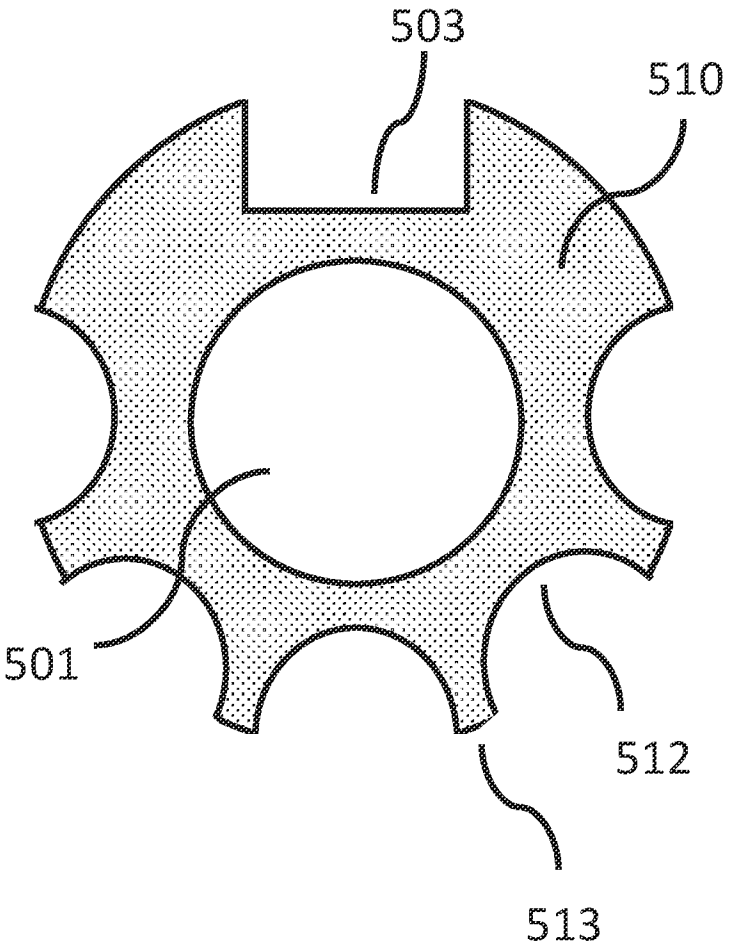

Referring to FIG. 5A, gullet mandrel 510 comprises five gullets 512. Between each of the gullets is located a protrusion/tooth 513. Only one gullet and tooth is labeled for simplicity. FIG. 5A is substantially similar to FIG. 4A but includes an additional gullet on the other side of valve recess 503. In one embodiment, each of the gullets 512 is the same size and shape, while in other embodiments there may be two or more different configurations of gullets. The gullet is substantially arcuate, which (which is effectively a half circle or semi-circular or simply an arc or other portion of a circle). In a perspective view, the gullet may be cylindrical or partially cylindrical.

Figure 5D:
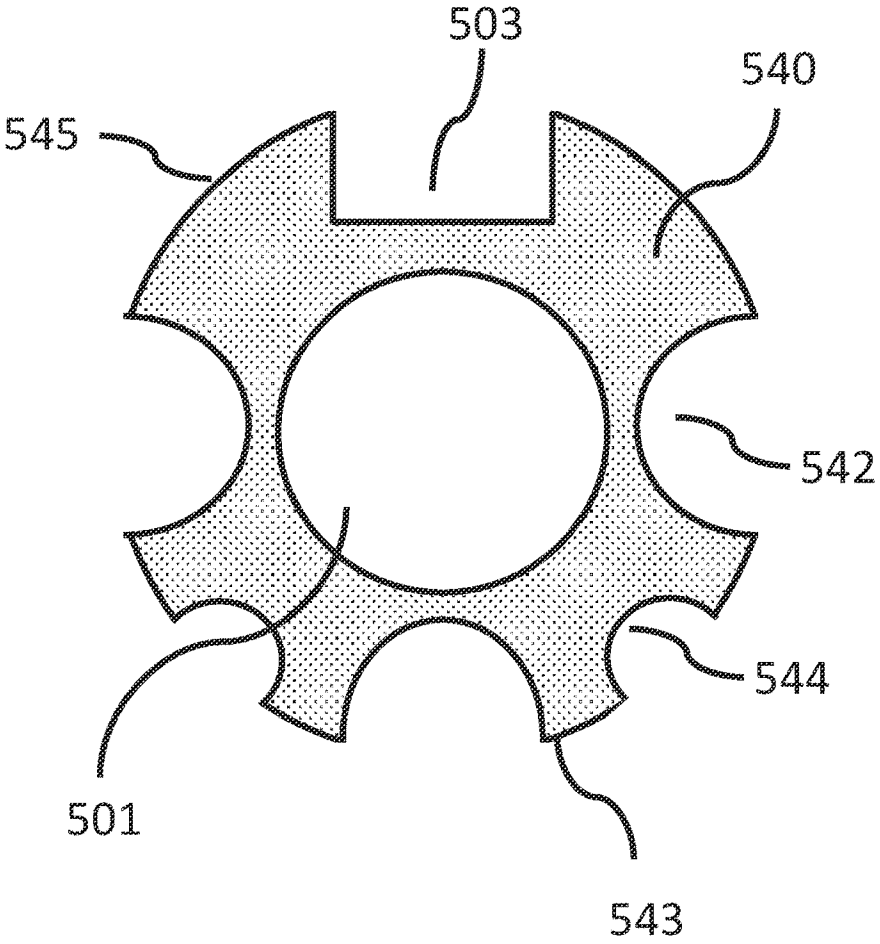
Figure 5C:
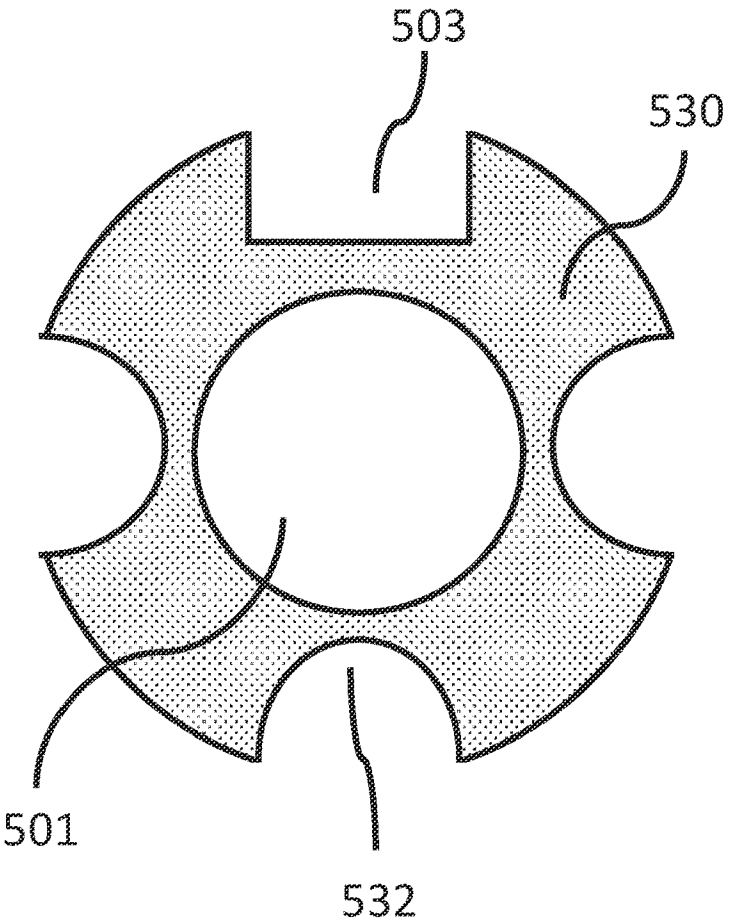
Figure 5F:
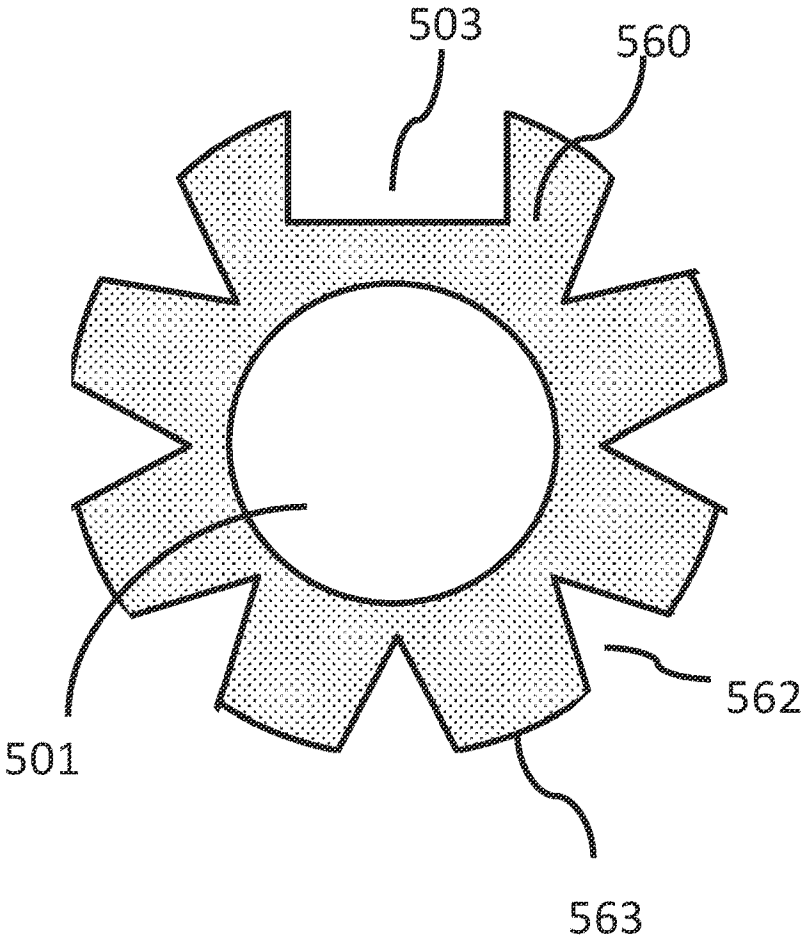
Figure 5E:
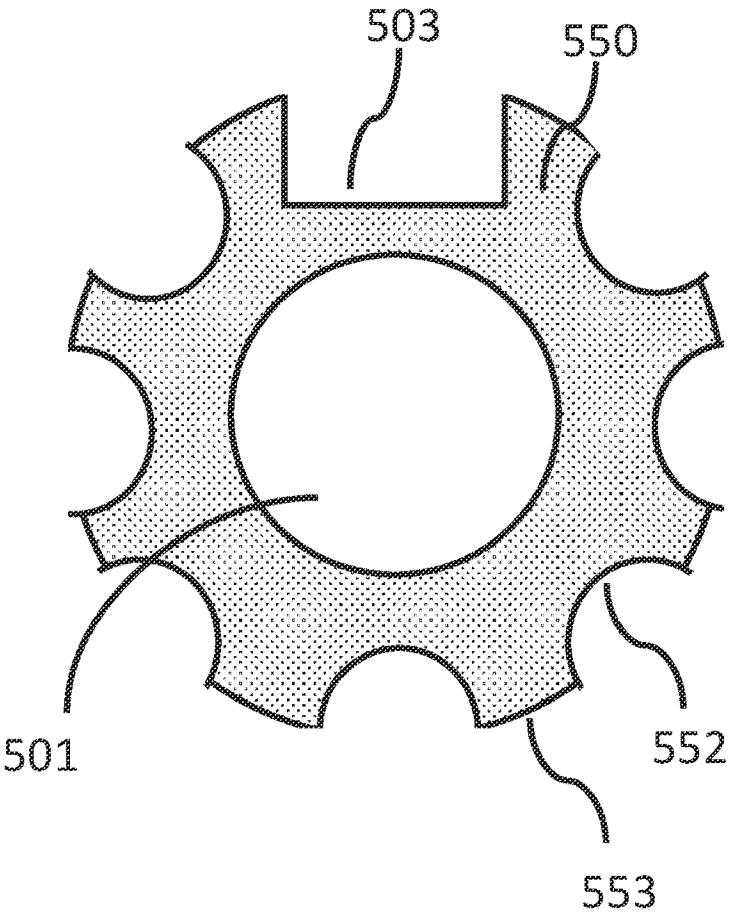

Referring to FIG. 5B, gullet mandrel 520 comprises two gullets 522 (only one is labelled for simplicity) on opposing sides of the mandrel. In one embodiment, each of the gullets 522 is the same size and shape, and may be partially or substantially circular or arcuate. Referring to FIG. 5C, gullet mandrel 530 comprises three gullets 532 (only one is labelled for simplicity) arranged in a symmetrical fashion around the mandrel body. Two of the gullets are on opposing sides of the mandrel and one of the gullets is on an opposing side of the valve recess 503. In one embodiment, each of the gullets 532 is the same size and shape, and may be partially or substantially circular or arcuate. The embodiment of FIG. 5C is substantially similar to the embodiment of FIG. 5B but for the addition of an extra gullet on an opposing side of valve recess 503. Referring to FIG. 5D, gullet mandrel 540 comprises five gullets, with three of the gullets (gullets 542) having a first configuration and/or size and two of the gullets (gullets 544) having a second configuration and/or size. Between each of the gullets is located a protrusion/tooth 543 (which may include different sized teeth). Each of the gullets may be partially or substantially circular or arcuate. The embodiment of FIG. 5C is substantially similar to the embodiment of FIG. 5C but for the addition of an extra pair of gullets 544 between each of the gullets 542. Referring to FIG. 5E, gullet mandrel 550 comprises seven gullets 552 (only one is labelled for simplicity) arranged in a symmetrical fashion around the mandrel body, each of which may have the same size and shape. For example, one gullet may be located on the opposing side of the valve recess 503 and three gullets may be located on opposing sides of the mandrel body. Between each of the gullets is located a protrusion/tooth 553. In one embodiment, each of the gullets 552 is the same size and shape, and may be partially or substantially circular or arcuate. Referring to FIG. 5F, gullet mandrel 560 comprises seven gullets 562 (only one is labelled for simplicity) arranged in a symmetrical fashion around the mandrel body. The embodiment of FIG. 5F is substantially similar to the embodiment of FIG. 5E but for the shape of the gullets. For example, gullets 562 of FIG. 5F may be substantially triangular or rectangular, while gullets 552 of FIG. 5E may be partially or substantially circular or arcuate. Between each of the gullets is located a protrusion/tooth 563.

FIGS. 6A-6F illustrate perspective views of various embodiments of a gullet mandrel according to the present disclosure. In one embodiment, the mandrel has one or more gullets located in an exterior portion of the mandrel body. The mandrel may have any number, shape, sizes, and/or or configurations of gullets. In one embodiment the gullets are located along a substantial portion (such as all) of the mandrel, while in other embodiments only part of the mandrel may have the gullets. The gullets may be axially located around the mandrel and may be helical, spiral, or straight. The mandrel may be substantially cylindrical, and may or may not be tapered at one or more ends.

Figure 6A:
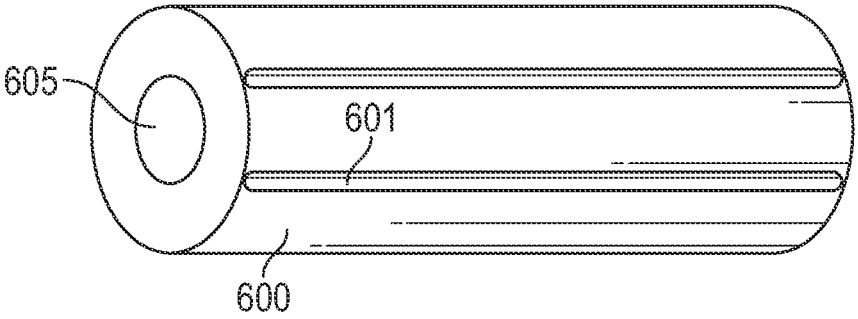
FIGS. 6A-6F illustrate a perspective view of various embodiments of a gullet mandrel according to the present disclosure.
Figure 6B:
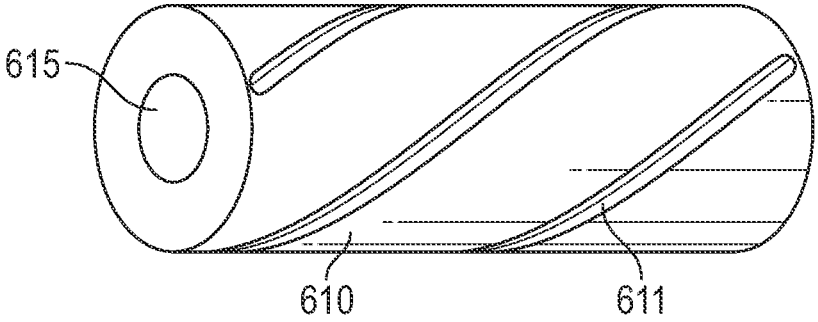
Figure 6C:
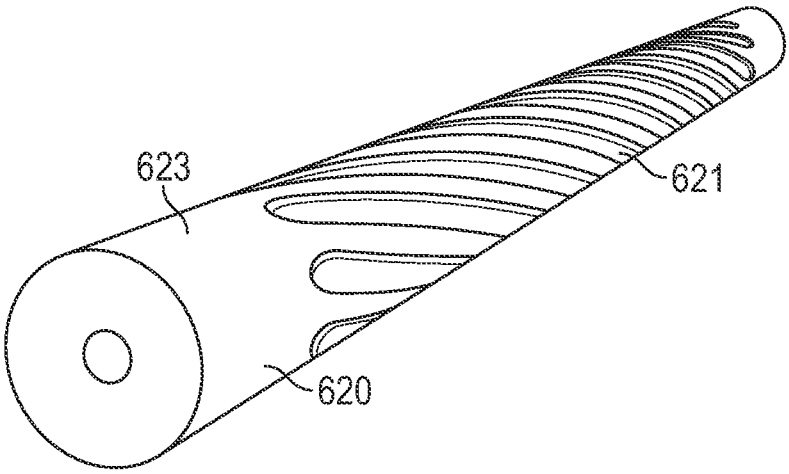
Figure 6D:
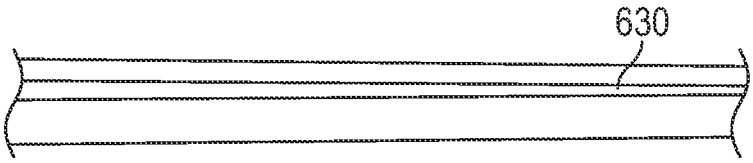
Figure 6E:
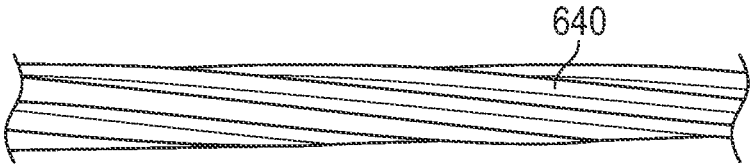
Figure 6F:
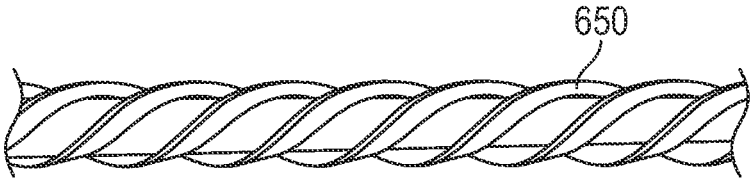

FIG. 6A illustrates a substantially cylindrical mandrel with a plurality of gullets arranged in a substantially straight pattern along a length of the mandrel. In particular mandrel 600 has an exterior in which gullets 601 are located. FIG. 6B is similar to FIG. 6A, but shows a plurality of gullets 611 arranged in a substantially spiral or helical pattern along a length of the mandrel 610. Inner passageway 605, 615 is located within the mandrels of FIGS. 6A, 6B, respectively. While only two gullets are shown in FIG. 6A and three gullets are shown in FIG. 6B, one of skill in the art will realize that more gullets may be located on an exterior of the body. Further, while the gullets illustrated in FIGS. 6A and 6B are generic, one of skill in the art will realize that a gullet may be any shape, whether circular, non-circular, triangular, rectangular, etc. FIG. 6C illustrates a substantially cylindrical mandrel 623 with a plurality of gullets 621 arranged in a substantially diagonal pattern along a length of the mandrel 620. The gullets are cylindrically tapered, and appear over a substantial portion of the surface of the mandrel. Near both ends of the mandrel a portion of the mandrel does not include the gullets. FIGS. 6D-6F illustrate other various embodiments of a mandrel with a plurality of gullets. FIG. 6D illustrates a tapered cylindrical mandrel portion with a plurality of straight gullets 630. FIG. 6E illustrates a tapered cylindrical mandrel portion with a plurality of spiral gullets 640. FIG. 6F illustrates a tapered cylindrical mandrel portion with a plurality of helical gullets 650. One of skill in the art will realize that any of the gullet configurations illustrated in FIGS. 6A-6F may be utilized for the mandrel disclosed herein, such as FIGS. 1A, 3A, 3E, 4A, and 7A, among others.

Figure 7A:
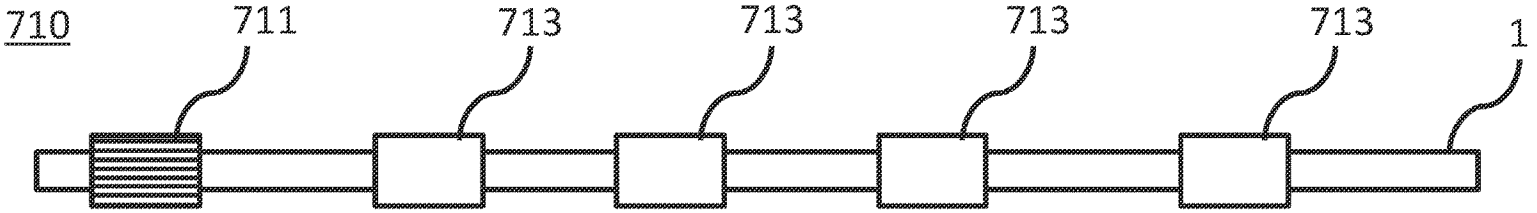
FIGS. 7A-7C illustrates a schematic view of a plurality of downhole valve assemblies coupled to a tubing string according to one embodiment of the present disclosure.
Figure 7B:
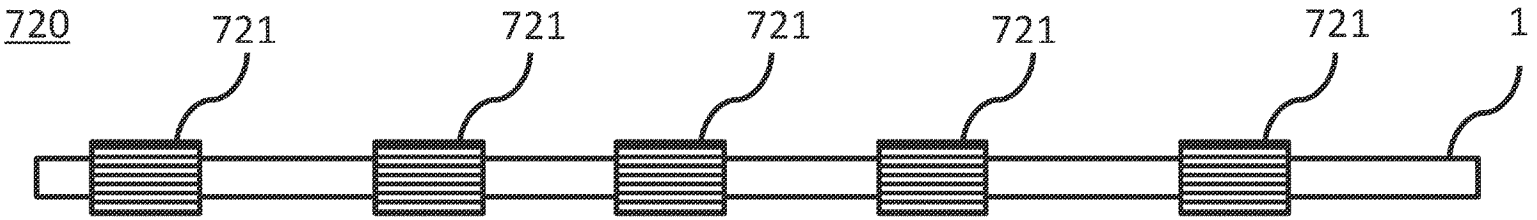
Figure 7C:
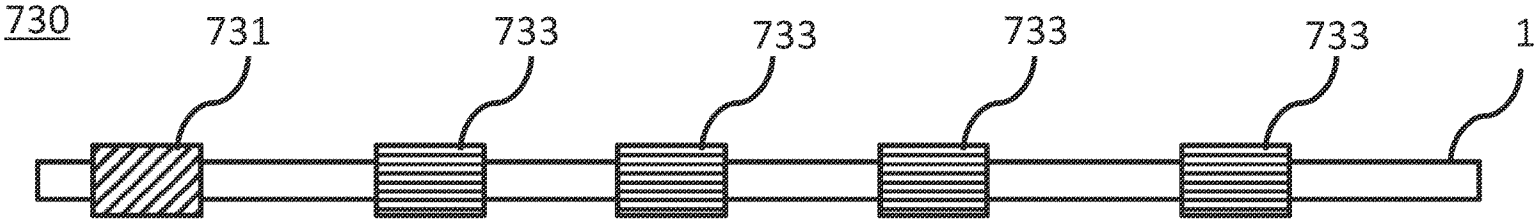

FIGS. 7A-7C illustrates a schematic view of a plurality of downhole valve assemblies coupled to a tubing string according to one embodiment of the present disclosure. In one embodiment, the plurality of downhole valves illustrated in FIGS. 7A-7C may be substantially similar to the plurality of valves 14 illustrated in FIG. 1B. For example, a plurality of downhole valves 14 (such as 14*a*, 14*b*, 14*c*, . . . , 14*x*, . . . , and 14*z*) may be coupled to tubing string 1 which is located with a cased wellbore thereby forming an annulus outside of tubing 1. In one embodiment, each of the plurality of downhole valve has one or more pressure sensors coupled to the valve that measures an inside pressure of the tubing string and a pressure outside of the tubing string in an annulus 3, such as described in relation to FIG. 1B. In one embodiment, a control system may be located at or near the wellbore surface, and is thus a remote control system relative to each of the downhole valves. The control system is electrically coupled to each of the plurality of downhole valves 14. In one embodiment, control system is coupled to the downhole valves by a single control wire, such as described in relation to FIGS. 1A and 1B. In other embodiments, the control system may communicate with and/or control each of the downhole valves by a wireless electronical signal as is known in the art. In one embodiment, each of the downhole valves illustrated in FIGS. 7A-7C is coupled to a mandrel.

FIG. 7A illustrates one embodiment where a tubing string is coupled to a plurality of downhole valves with a gullet mandrel at a single location. In one embodiment, system 710 comprises gullet mandrel 711 located at the lowest downhole valve position in the wellbore. The gullet mandrel may have gullets that are straight shaped, spiral shaped, or helically shaped. In one embodiment, gullet mandrel 711 comprises one or more substantially straight gullets on an exterior portion of the mandrel. The remaining (upper) mandrels 713 are all conventional mandrels without any gullets, such as a mandrel disclosed in FIGS. 3A and 4A. In this embodiment, the first mandrel that the injected gas and/or produced fluid is in communication with is the gullet mandrel, which facilitates fluid flow across the mandrel and through the rest of the wellbore. In other words, the most important mandrel along the tubing string may be the first mandrel that the fluid sees, and thus a gullet mandrel may be positioned at the lowest point of the wellbore to minimize fluid disruption at the most likely point of fluid disruption in the wellbore.

FIG. 7B illustrates one embodiment where a tubing string is coupled to a plurality of downhole valves with a gullet mandrel at a plurality of locations. In one embodiment, system 720 comprises gullet mandrel 721 located at each of the plurality of downhole valve positions in the wellbore, from the top to the bottom. In other embodiments, some, most, or substantially all of the utilized mandrels along the tubing string are gullet mandrels. Like the mandrel described in FIG. 7A, the gullet mandrel may have gullets that are straight shaped, spiral shaped, or helically shaped around the mandrel, and each gullet may have any number of configurations. In one embodiment, gullet mandrel 721 comprises one or more substantially straight gullets on an exterior portion of the mandrel. In this embodiment, all of the mandrels have gullets, which facilitates fluid flow across each of the mandrels and through the entirety of the wellbore. In other words, each of the mandrels helps minimize fluid disruption within the wellbore and around the mandrel and associated downhole valve.

FIG. 7C illustrates one embodiment where a tubing string is coupled to a plurality of downhole valves with two different gullet mandrels at different locations. In one embodiment, system 730 comprises first gullet mandrel 731 located at the lowest downhole valve position in the wellbore, and second gullet mandrel 733 located at one or more of the upper valve positions. In one embodiment, the first gullet 731 mandrel has a first set of gullet configurations and the second gullet mandrel 733 has a second set of gullet configurations. In another embodiment, the first gullet 731 comprises helically shaped gullets around the mandrel, whereas the second gullet 733 comprises substantially straight shaped gullets around the mandrel. The second gullet mandrels may have gullets that are straight shaped, spiral shaped, or helically shaped. In this embodiment, like FIG. 7B, all of the mandrels have gullets, which facilitates fluid flow across each of the mandrels and through the entirety of the wellbore. In other words, each of the mandrels helps minimize fluid disruption within the wellbore and around the mandrel and associated downhole valve. However, like FIG. 7A, the first mandrel is considered the most important mandrel because it is the most likely point of fluid disruption in the wellbore, and it may have a special gullet mandrel (such as helically shaped gullet mandrel 731) which helps to facilitate fluid flow more than the other mandrel locations.

In one embodiment, the gullet mandrel is specifically designed to help slow down turbulent flow for fluid flowing in an annulus of the tubing string (e.g., the portion between the wellbore wall and the tubing string/pipe). In one embodiment, the gullets may be configured to facilitate linear flow of the fluid and to prevent slug flow and other undesirable fluid flow situations. In one embodiment, a benefit of the gullet mandrel is to minimize the mass of the mandrel by removing portions of the mandrel that are not useful or needed during use of the mandrel and/or operation of the valve within the mandrel. As much mass may be removed from the exterior portion of the mandrel body while still maintaining structural integrity of the mandrel and its ability to withstand force, pressure, and other stressful situations. In one embodiment, as large a groove as possible is made to keep the remaining mandrel portions to withstand at least 5000 psi, and in some embodiments up to 10,000 psi. One of skill in the art will realize that other pressures may be specifically designed based on the particular application of the mandrel. In one embodiment, the gullet can be made as close as 0.25" inches from an interior passageway of the mandrel.

The gullets may be formed by a variety of procedures as is known in in the art. In one embodiment, the gullets are machined out of a cylindrical metal piece. The gullets may be formed before or after the primary passageway (see, e.g., element 403 in FIG. 4A) is formed. In some embodiments the mandrel may be cast as a whole unit or partial unit (whether metallic or non-metallic), whereby previously formed gullets shapes have been formed in a mold.

In one embodiment, the mandrel is approximately 3½" in diameter and is coupled to a tubing string with a pipe diameter of approximately 4½" in diameter. The mandrel may be greater or less than a diameter of the tubing string. In one embodiment, the mandrel may be coupled to any tubular used in a wellbore environment. In one embodiment, the downhole tubular comprises jointed tubing, such as any standard tubing sizes of 2⅜", 2⅞", 3½", etc. The inner diameter of the mandrel increases based on the size of the tubing selected; likewise, the outer diameter of the mandrel is sized according to the production tubing that it resides within (such as 4½", 5½", 6½", etc. In other embodiments, the downhole tubular comprises production lining or slotted lining.

All of the methods disclosed and claimed herein can be made and executed without undue experimentation in light of the present disclosure. While the apparatus and methods of this invention have been described in terms of preferred embodiments, it will be apparent to those of skill in the art that variations may be applied to the methods and in the steps or in the sequence of steps of the method described herein without departing from the concept, spirit and scope of the invention. In addition, modifications may be made to the disclosed apparatus and components may be eliminated or substituted for the components described herein where the same or similar results would be achieved. All such similar substitutes and modifications apparent to those skilled in the art are deemed to be within the spirit, scope, and concept of the invention.

Many other variations in the system are within the scope of the invention. For example, the mandrel may be used in any downhole application for fluid production or injection and is not limited to artificial lift applications. For example, it may be used in artificial lift, gas lift, and/or enhanced oil recovery operations, as well as carbon dioxide sequestration. As another example, the disclosed gullet mandrel may have any number or configuration of grooves. For example, two, three, or four or more grooves may be located in an exterior portion of the mandrel. The groove may be any shape, whether circular, non-circular, triangular, rectangular, etc. The grooves may be axially located around the mandrel and may be helical, spiral, or straight grooves. In one embodiment the grooves are located along a substantial longitudinal portion of the mandrel, while in other embodiments only part of the mandrel may have the grooves. Any number of securing brackets may be utilized (such as between one to four or more brackets). A shroud or protective covering may be coupled to the mandrel to protect the securing brackets and enclosed valve and electronic equipment. It is emphasized that the foregoing embodiments are only examples of the very many different structural and material configurations that are possible within the scope of the present invention.

Although the invention(s) is/are described herein with reference to specific embodiments, various modifications and changes can be made without departing from the scope of the present invention(s), as presently set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

What is claimed is:

1. A downhole mandrel, comprising:

a body;

a main passage within the body;

a plurality of gullets located in an exterior portion of the body; and a channel configured to receive a valve assembly located in an exterior portion of the body.

2. The mandrel of claim 1, wherein the plurality of gullets runs longitudinally along a substantial length of the body.

3. The mandrel of claim 1, wherein the mandrel is configured to couple with a tubing string, wherein the main passage is fluidly coupled to a main passage of the tubing string.

4. The mandrel of claim 1, wherein the plurality of gullets comprises at least three gullets.

5. The mandrel of claim 1, wherein the plurality of gullets comprises at least four gullets.

6. The mandrel of claim 1, wherein each of the plurality of gullets has substantially the same shape.

7. The mandrel of claim 1, wherein the plurality of gullets comprises one or more gullets with a first configuration and one or more gullets with a second configuration.

8. The mandrel of claim 1, wherein the plurality of gullets comprises a first plurality of gullets with a first configuration and a second plurality of gullets with a second configuration.

9. The mandrel of claim 1, further comprising a protrusion of the body located between each of the plurality of gullets.

10. The mandrel of claim 1, wherein each of the plurality of gullets comprises a groove.

11. The mandrel of claim 1, wherein each of the plurality of gullets is substantially arcuate.

12. The mandrel of claim 1, wherein at least some of the plurality of gullets is circular.

13. The mandrel of claim 1, wherein the plurality of gullets is located symmetrically around the mandrel.

14. The mandrel of claim 1, wherein the plurality of gullets is helically arranged around the mandrel.

15. The mandrel of claim 1, wherein the plurality of gullets is arranged in a spiral around the mandrel.

16. The mandrel of claim 1, wherein the plurality of gullets is arranged in substantially straight lines around the mandrel.

17. The mandrel of claim 1, wherein the channel runs longitudinally along a substantial length of the body.

18. The mandrel of claim 1, further comprising a valve assembly positioned in the channel.

19. The mandrel of claim 1, wherein the main passage is located substantially in a center of the body.

20. The mandrel of claim 1, wherein the main passage is located off center within the body.

21. The mandrel of claim 1, wherein the mandrel is a gas lift mandrel.

22. The mandrel of claim 1, wherein the plurality of gullets is configured to direct fluid in an annulus of a wellbore into linear flow.

23. The mandrel of claim 1, wherein the plurality of gullets is configured to prevent slug flow.

24. The mandrel of claim 1, wherein the plurality of gullets is configured to assist fluid flow movement in an annulus of a downhole well.

25. The mandrel of claim 1, further comprising a shroud coupled to the body.

26. The mandrel of claim 25, wherein the shroud does not substantially cover the plurality of gullets.

27. The mandrel of claim 1, further comprising a shroud, wherein the shroud substantially covers the valve assembly.

28. The mandrel of claim 1, further comprising a shroud and a plurality of securing brackets that couple the valve assembly to the body, wherein the shroud substantially covers the plurality of securing brackets.

29. A downhole valve system, comprising:

a plurality of mandrels coupled to a tubing string; and a downhole valve coupled to each of the plurality of mandrels, wherein a bottom most of the plurality of mandrels comprises a first mandrel configuration with a plurality of gullets in an exterior portion of the mandrel and the remaining plurality of mandrels comprises a second mandrel configuration.

30. The system of claim 29, wherein the second mandrel configuration comprises mandrels with no gullets.

31. The system of claim 29, wherein the second mandrel configuration comprises a plurality of substantially straight gullets.

32. The system of claim 31, wherein the plurality of gullets of the first mandrel configuration comprises a plurality of spiral gullets.

33. The system of claim 29, wherein at least one of the plurality of mandrels comprises a shroud.

34. A downhole mandrel, comprising:

a body;

a main passage within the body;

a plurality of gullets located in an exterior portion of the body;

a valve assembly; and a shroud, wherein the shroud substantially covers the valve assembly.

35. The mandrel of claim 34, wherein the shroud does not substantially cover the plurality of gullets.

36. The mandrel of claim 34, further comprising a plurality of securing brackets that couple the valve assembly to the body, wherein the shroud substantially covers the plurality of securing brackets.

37. A downhole gas lift mandrel, comprising:

a main passage within the body, wherein the main passage is located off center within the body;

a first plurality of gullets on a first exterior side of the body; and a second plurality of gullets on a second exterior side of the body, wherein the first exterior side is opposite to the second exterior side, wherein the first plurality of gullets comprises the same configuration as the second plurality of gullets, wherein each of the first and second plurality of gullets has a first gullet with a first size and a second gullet with a second size, wherein each of the first and second plurality of gullets is arranged in substantially straight lines around the mandrel.

38. The mandrel of claim 37, further comprising a channel configured to receive a valve assembly located in an exterior portion of the body, wherein the channel is located on the opposite side of the off-center main passage and between the first and second plurality of gullets.

39. The mandrel of claim 38, further comprising a valve assembly positioned in the channel.

40. The mandrel of claim 39, further comprising a shroud, wherein the shroud substantially covers the valve assembly.

41. The mandrel of claim 37, wherein each of the plurality of gullets comprises a diameter of between 0.5" and 2.0" inches.

* * * * *